US008699891B2

(12) United States Patent
Furusawa et al.

(10) Patent No.: US 8,699,891 B2
(45) Date of Patent: Apr. 15, 2014

(54) DETECTION APPARATUS AND IMAGE FORMING APPARATUS

(75) Inventors: Fumio Furusawa, Kanagawa (JP); Masao Ito, Kanagawa (JP); Katsuhiko Nakaie, Kanagawa (JP); Junichi Morooka, Kanagawa (JP); Shusaku Yokota, Kanagawa (JP); Kota Ninomiya, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 252 days.

(21) Appl. No.: 13/101,600

(22) Filed: May 5, 2011

(65) Prior Publication Data

US 2012/0106987 A1 May 3, 2012

(30) Foreign Application Priority Data

Oct. 29, 2010 (JP) ..... 2010-244547

(51) Int. Cl.
*G03G 15/00* (2006.01)

(52) U.S. Cl.
USPC ..... 399/15

(58) Field of Classification Search
USPC ..... 399/15, 74
See application file for complete search history.

(56) References Cited

U.S. PATENT DOCUMENTS

| | | | | |
|---|---|---|---|---|
| 4,936,141 | A * | 6/1990 | Anderson et al. | 73/159 |
| 2002/0126330 | A1 * | 9/2002 | Farrell | 358/538 |
| 2007/0053711 | A1 * | 3/2007 | Litwiller | 399/82 |
| 2008/0056737 | A1 * | 3/2008 | Flemming et al. | 399/15 |

FOREIGN PATENT DOCUMENTS

JP 2010-114498 A 5/2010

OTHER PUBLICATIONS

JP 2010-114498 English translation, Ito, May 2010.*

* cited by examiner

*Primary Examiner* — David Gray
*Assistant Examiner* — Thomas Giampaolo, II
(74) *Attorney, Agent, or Firm* — Sughrue Mion, PLLC

(57) ABSTRACT

A detection apparatus includes a transmission member that is provided facing a conveying path on which a medium is conveyed and that transmits light from the medium being conveyed on the conveying path; a detection section that detects the medium or an image on the medium according to the light which is transmitted by the transmission member, wherein the light is received by a light-receiving member of the detection section; and an opposing member provided on an opposite side of the conveying path from the transmission member and having at least one opposing surface that faces the transmission member. In a conveying direction of the medium, a length of the opposing surface is shorter than a length of a detection surface.

15 Claims, 12 Drawing Sheets

DETECTION APPARATUS AND IMAGE FORMING APPARATUS

CROSS-REFERENCE TO RELATED APPLICATIONS

This application is based on and claims priority under 35 USC 119 from Japanese Patent Application No. 2010-244547 filed on Oct. 29, 2010.

BACKGROUND OF THE INVENTION

1. Technical Field

This invention relates to a detection apparatus and an image forming apparatus.

2. Related Art

According to an image forming apparatus described in JP-A-2010-114498, an image reading section is arranged at a downstream side of an image forming section on a sheet transfer path, and the image reading section reads an image formed on a sheet by the image forming section. Moreover, this image reading section has a reference member having a polyhedron shape for calibration of each part of image formation. In the reference member, plural surfaces (white, black and colored reference surfaces) are provided. The white reference surfaces are used for reading in a state in which a sheet is not conveyed.

SUMMARY

A detection apparatus according to a first aspect of the present invention includes: a transmission member that is provided facing a conveying path on which a medium is conveyed and transmits a light from the medium which is conveyed on the conveying path; a detection section that detects the medium or an image on the medium according to the light which is transmitted by the transmission member, wherein the light is received by a light-receiving member of the detection section; and an opposite member provided on an opposite side of the conveying path from the transmission member, and having at least one opposing surface that faces the transmission member. A length of the at least one opposing surface is shorter than a length of a detection surface in a conveying direction of the medium.

BRIEF DESCRIPTION OF THE DRAWINGS

Embodiments of the present invention will be described in detail based on the following figures, wherein.

DESCRIPTION

A detection apparatus and an image forming apparatus according to an exemplary embodiment of the present invention will be described.

(Entire Structure)

Figure 1:
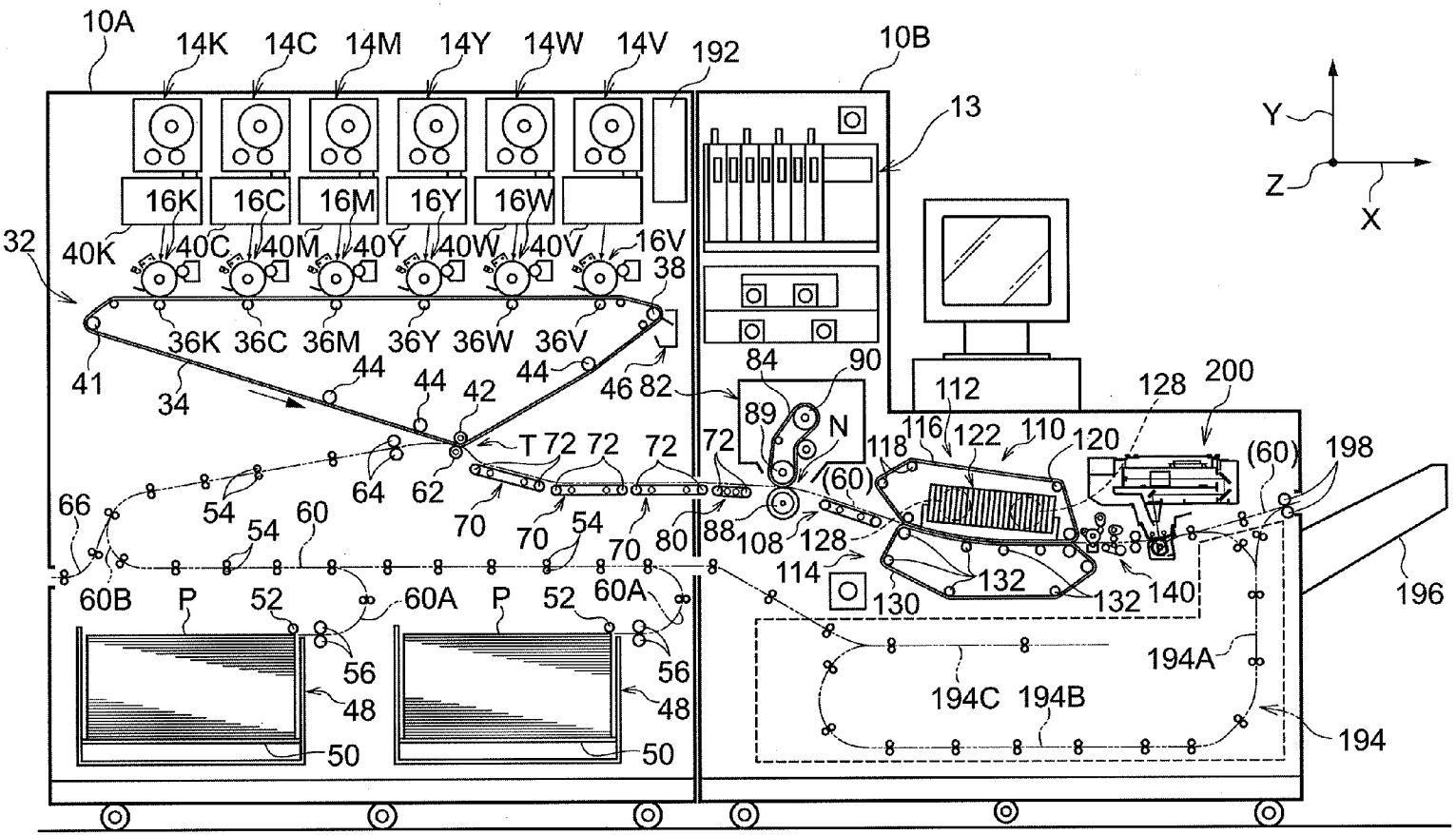
FIG. 1 is an overall view of an image forming apparatus according to an exemplary embodiment of the present invention.

FIG. 1 shows an image forming apparatus 10. The image forming apparatus 10 forms a color image or a monochrome image, and has a first processing unit 10A which is located on the left-hand side in front view and a second processing unit 10B which is located on the right-hand side and can be attached to and detached from the first processing unit 10A. Casings of the first processing unit 10A and the second processing unit 10B are formed by plural frame members. In the following description, a length direction of the image forming apparatus 10 (a sub-scanning direction, which is a conveying direction of a recording medium P, which is an example of a medium) is described as the X direction, a height direction of the apparatus is described as the Y direction, and a depth direction of the apparatus (main scanning direction) is described as the Z direction.

Toner cartridges 14V, 14W, 14Y, 14M, 14C, 14K which respectively house toners of a first custom color (V), a second custom color (W), yellow (Y), magenta (M), cyan (C) and black (K) are provided so as to be replaceable at an upper part of the first processing unit 10A along the horizontal direction.

The first custom color and the second custom color are arbitrarily selected from colors (including a transparent color) other than yellow, magenta, cyan and black. Moreover, in the following description, when distinguishing between the first custom color (V), the second custom color (W), yellow (Y), magenta (M), cyan (C) and black (K), one of the Roman letters V, W, Y, M, C, K will be added after the reference numeral and, when not distinguishing between the colors, the Roman letters V, W, Y, M, C, K will be omitted.

Further, at a lower side of the toner cartridges 14, image forming units 16, which are examples of six image forming portions corresponding to the toners of the respective colors, are provided along the X direction so as to correspond with the respective toner cartridges 14. An exposure device 40 which is provided for each image forming unit 16 is configured so that it receives image data which is used for image processing from an image signal processing unit 13 provided at an upper part of the second processing unit 10B. The exposure device 40 irradiates an optical beam L modulated according to the image data onto a photosensitive drum 18 (FIG. 2) which will be described below.

Figure 2:
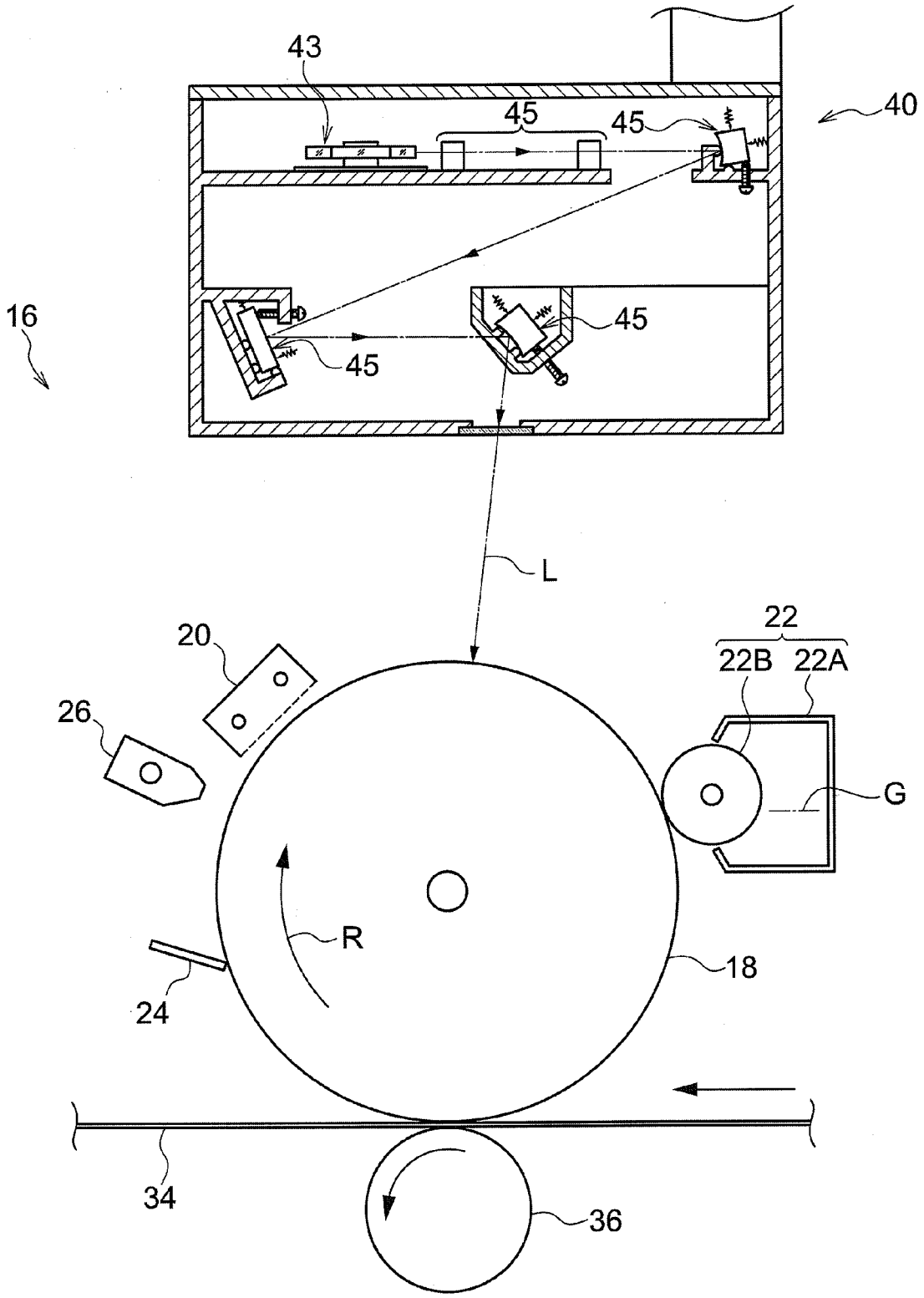
FIG. 2 is a schematic diagram of an image forming unit according to the exemplary embodiment of the present invention.

As shown in FIG. 2, each image forming unit 16 has a photosensitive drum 18 that is rotationally driven in a direction of an arrow R (clockwise direction as shown). On each photosensitive drum 18, an electrostatic latent image is formed by the optical beam L irradiated from each exposure device 40. The exposure device 40 scans in the main scanning direction with a light emitted from a light source (not shown) using a polygon mirror 43, and irradiates the optical beam L on an outer circumference surface of the photosensitive drum 18 using plural optical components 45 including an fθ lens and a reflecting mirror, thereby performing exposure.

Around each photosensitive drum 18, a scorotron charging device 20 is provided which is a corona discharge type (contactless charge type) to charge the photosensitive drum 18, a developing device 22 which develops the electrostatic latent image formed on the photosensitive drum 18 by the exposure device 40 with a developing material (toner), a blade 24 which removes residual toner from the photosensitive drum 18 after primary transfer, and a discharge apparatus 26 which irradiates a light on the photosensitive drum 18 to perform discharge after the toner is removed by the blade 24. The scorotron charging device 20, the developing device 22, the blade 24 and the discharge apparatus 26 are located in this order from the upstream side of a rotation direction of the photosensitive drum 18 to the downstream side while facing the surface of the photosensitive drum 18.

The developing device 22 is configured so as to include a developing material housing member 22A which houses the developing material G including the toner and, a developing roll 22B which provides the developing material G housed in the developing material housing member 22A to the photosensitive drum 18. The housing member 22A is connected to the toner cartridge 14 (refer to FIG. 1) via a toner providing path (not shown), and the toner is provided from the toner cartridge 14.

As shown in FIG. 1, a transfer unit 32 is provided at a lower side of each image forming unit 16. The transfer unit 32 is configured so as to include a circular intermediate transfer belt 34 the outer circumferential surface of which contacts with the outer circumferential surface of each photosensitive drum 18, and a primarily transfer roll 36 for multiply transferring the toner images formed on each of photosensitive drums 18 to the intermediate transfer belt 34.

The intermediate transfer belt 34 is wound on a driving roll 38 which is driven by a motor (not shown), a tension applying roll 41 which applies tensional force to the intermediate transfer belt 34, an opposing roll 42 which is provided opposite to the secondary transfer roll 62 described below, and plural winding rolls 44. The intermediate transfer belt 34 is circularly moved in one direction (counterclockwise direction in the figure) by the driving roll 38.

Each primarily transfer roll 36 is arranged opposite to the photosensitive drum 18 of each corresponding image forming unit 16 with the intermediate transfer belt 34 interposed therebetween. A transfer bias voltage that has the opposite polarity to the toner polarity is applied to the primarily transfer roll 36 by a power supply unit (not shown). This configuration causes the toner image formed on the photosensitive drum 18 to be transferred onto the intermediate transfer belt 34.

At the opposite side of the intermediate transfer belt 34 from the driving roll 38 a removal device 46 is provided in which a blade contacts with the outer circumferential surface of the intermediate transfer belt 34 to remove residual toner and paper dust or the like from the intermediate transfer belt 34. At a lower part of the transfer unit 32, two recording medium housing units 48 are provided along the horizontal direction, the housing units 48 housing recording media such as paper.

Each recording medium housing unit 48 can be drawn out in the Z direction from the first processing unit 10A toward a front side thereof. Moreover, at an upper part of one end side (right side in FIG. 1) of each recording medium housing unit 48, a sending roll 52 is provided to send a recording medium P from each recording medium housing unit 48 to a conveying path 60, which is an example of a conveying path. Further, a bottom plate 50 is provided in each recording medium housing unit 48 on which the recording medium P is placed. The bottom plate 50 is lowered according to an instruction from a controlling means (not shown) when the recording medium housing unit 48 is drawn from the first processing unit 10A. The lowering of the bottom plate 50 forms a space for a user to refill the recording medium P in the recording medium housing unit 48.

When the recording medium housing unit 48 which has been drawn from the first processing unit 10A is reattached to the first processing unit 10A, the bottom plate 50 rises according to an instruction from the controlling means. Then, due to the rising of the bottom plate 50, the top recording medium P placed on the bottom plate 50 contacts the sending roll 52. A separating roll 56 is provided that separates any overlapping recording medium P sent from the recording medium housing unit 48 into single sheets, at the downstream side in a recording medium conveying direction of the sending roll 52 (hereinafter, sometimes simply referred to as a downstream side). Plural conveying rolls 54, which convey the recording medium P to the downstream side, are provided at the downstream side of the separating roll 56.

A conveying path 60 provided between the recording medium housing unit 48 and the transfer unit 32 extends toward a transfer position T which is provided between the secondary transfer roll 62 and the opposing roll 42. The recording medium P sent from the recording medium housing unit 48 is conveyed while turning to the left-hand side in FIG. 1 at a first turning part 60A, and is further turned to the right-hand side in FIG. 1 at a second turning part 60B.

The secondary transfer roll 62 is configured so that a transfer bias voltage which has the opposite polarity to the toner polarity is applied thereto by a power supply portion (not shown). Accordingly, toner images of respective colors multiply-layered on the intermediate transfer belt 34 are secondarily transferred, by the secondary transfer roll 62, to the recording medium P conveyed along the conveying path 60.

Further, an auxiliary path 66 is provided which extends from the left-hand side surface of the first processing unit 10A so as to join the second turning part 60B of the conveying path 60. A recording medium P sent from another recording medium housing unit (not shown) adjacently located at a left-hand side of the first processing unit 10A can cut into the conveying path 60 via the auxiliary path 66.

At the downstream side of the transfer position T on the conveying path 60 in the first processing unit 10A, plural conveying belts 70 are provided, which are examples of a conveying section which conveys the recording medium P onto which the toner images have been transferred to the second processing unit 10B. A conveying belt 80 is provided as an example of a conveying section which conveys the recording medium P conveyed by the conveying belts 70 toward the downstream side in the second processing unit 10B.

Each of the plural conveying belts 70 and the conveying belt 80 are circularly formed and wound on a pair of winding rolls 72. The pair of winding rolls 72 is arranged at the upstream side and the downstream side in the conveying direction of the recording medium P, respectively. Rotary driving of one of the rolls causes the conveying belts 70 and the conveying belt 80 to circularly move in one direction (clockwise direction in FIG. 1). At the downstream side of the conveying belt 80, a fixing unit 82 is provided which fixes the transferred toner images to the surface of the recording medium P by heat and pressure.

The fixing unit 82 has a fixing belt 84 which is arranged at an upper side of the conveying path 60 (image forming surface side of the recording medium P), and a press roll 88 which is arranged so as to contact with the fixing belt 84 from underneath with the conveying path 60 interposed therebetween. A fixing part N is formed for fixing the toner image to the recording medium P by pressing and heating with the fixing belt 84 and the press roll 88.

The fixing belt 84 is formed in a circular fashion and is wound on a driving roll 89 and a driven roll 90 which are arranged one above the other. The driving roll 89 faces the press roll 88 from an upper side and the driven roll 90 is disposed higher than the driving roll 89. A heating unit such as a halogen heater is embedded in the driving roll 89 and the driven roll 90 respectively, thereby heating the fixing belt 84.

At the downstream side of the fixing unit 82, a conveying belt 108 is provided as an example of a conveying section which conveys the recording medium P sent from the fixing unit 82 to the downstream side. The conveying belt 108 has a configuration similar to the conveying belts 70. Moreover, a cooling unit 110 is provided at the downstream side of the conveying belt 108 which cools down the recording medium P heated by the fixing unit 82.

The cooling unit 110 includes an absorbing device 112 which absorbs heat from the recording medium, and a pressing device 114 which presses the recording medium P to the absorbing device 112. The absorbing device 112 is arranged at one side of the conveying path 60 (upper side in FIG. 1), and the pressing device 114 is arranged at the other side (lower side in FIG. 1).

The absorbing device 112 includes a circular absorbing belt 116 which is in contact with the recording medium P and absorbs the heat of the recording medium P. The absorbing belt 116 is wound on a driving roll 120, which transmits driving force to the absorbing belt 116, and plural winding rolls 118. Moreover, at an inner circumferential side of the absorbing belt 116, a heatsink 122 is provided which is made of aluminum materials and is in surface contact with the absorbing belt 116 to radiate the heat absorbed by the absorbing belt 116. Further, at a back side of the second processing unit 10B, a fan 128 is provided for discharging hot air generated by heat radiation of the heatsink 122 to the outside.

The pressing device 114 comprises a circular pressing belt 130, which is an example of a conveying section which conveys the recording medium P while pressing the recording medium P to the absorbing belt 116. The pressing belt 130 is wound on plural winding rolls 132.

At the downstream side of the cooling unit 110 on the conveying path 60, a correcting device 140 is provided which sandwiches and conveys the recording medium P, and corrects curling of the recording medium P. At the downstream side of the correcting device 140 on the conveying path 60, an inline sensor 200 is provided as an example of a detection apparatus which detects toner concentration defects, image defects, and image position defects of the toner image fixed on the recording medium P as well as the position and shape or the like of the recording medium P. The inline sensor 200 will be described in detail in the following.

At the downstream side of the inline sensor 200 on the conveying path 60, a discharging roll 198 is provided which discharges the recording medium P, on one side of which an image is formed, to a discharging unit 196 attached to a side surface of the second processing unit 10B. Note that in a case in which images are formed on both sides of the recording medium P, the recording medium P sent from the inline sensor 200 is conveyed to an inversion path 194 provided at the downstream side of the inline sensor 200.

On the inversion path 194, a branching path 194A is provided which branches from the conveying path 60, a sheet conveying path 194B is provided which conveys the recording medium P conveyed along the branching path 194A toward a first processing unit 10A side, and an inversion path 194C is provided in which the recording medium P conveyed along the sheet conveying path 194B is turned around toward the opposite direction to perform a switchback conveyance, thereby turning the medium upside down. This configuration causes the recording medium P that is switch-back conveyed by the inversion path 194C to be further transported toward the first processing unit 10A to join the conveying path 60 provided at upper part of the recording medium housing unit 48 and to be sent to the transfer position T again.

An image forming process of the image forming apparatus 10 will be explained in the following.

As shown in FIG. 1, image data processed by the image signal processing unit 13 are sent to each of the exposure devices 40. Then, as shown in FIG. 2, each of the exposure devices 40 emits a light beam L according to the image data and exposes the outer surface of each photosensitive drum 18 which is electrically charged by the scorotron charging device 20, and thus electrostatic latent images are formed. Furthermore, the electrostatic latent images formed on the photosensitive drums 18 are developed by the developing device 22, and toner images in the respective colors of the first custom color (V), the second custom color (W), yellow (Y), magenta (M), cyan (C) and black (K) are formed.

Subsequently, as shown in FIG. 1, toner images of respective colors formed on the photosensitive drums 18 (refer to FIG. 2) of the image forming units 16V, 16W, 16Y, 16M, 16C and 16K are multiply transferred to the intermediate transfer belt 34 using six primary transfer rolls 36V, 36W, 36Y, 36M, 36C and 36K. Then the toner images of respective colors multiply-layered on the intermediate transfer belt 34 are secondarily transferred, using the secondary transfer roll 62, onto the recording medium P conveyed from the recording medium housing unit 48. Furthermore, the recording medium P onto which the toner images are transferred is conveyed by the conveying belt 70 to the fixing unit 82 which is provided inside the second processing unit 10B.

Subsequently, the toner images of the respective colors on the recording medium P are fixed thereon at the fixing unit 82 by being heated and pressed. Then, the recording medium P having the fixed toner images is cooled down while passing through the cooling unit 110, after which the recording medium P is conveyed into the correcting device 140 and any curling that has occurred at the recording medium P is corrected. Further, the recording medium P with corrected curling is discharged to the discharging unit 196 by the discharging roll 198 after detection of image defects or the like by the inline sensor 200.

When forming an image on the other surface of the recording medium P on which an image is not formed (double-sided printing), the recording medium P is turned round at the inversion path 194 after passing through the inline sensor 200, and is sent to the conveying path 60 provided above the recording medium housing unit 48. Thus toner images are formed on the other surface according to the process described above.

In addition, in the image forming apparatus 10 according to this embodiment, components for forming images of the first custom color and the second custom color (the image forming units 16V and 16W, the exposure devices 40V and 40W, the toner cartridges 14V and 14W, and the primary transfer rolls 36V and 36W) are configured such that these components can be attached to and detached from the first processing unit 10A as optional units at the user's discretion. Therefore, the image forming apparatus 10 may be configured without either of the units of the first custom color and the second custom color, and may also be configured with only one or the other unit of the first custom color or the second custom color.

Next, the inline sensor 200 will be explained.

(Basic Configuration of the Inline Sensor 200)

Figure 3:
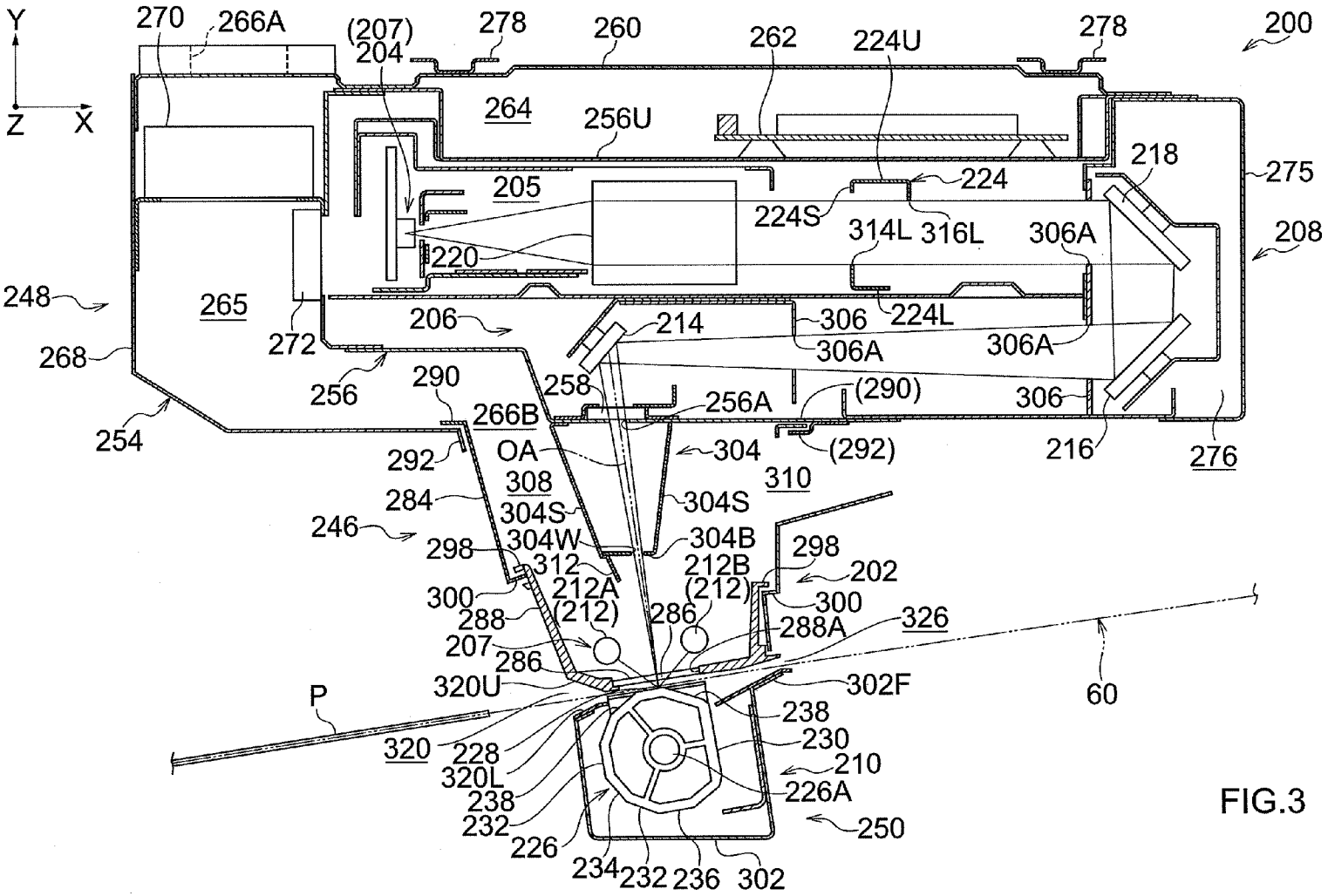
FIG. 3 is a schematic diagram of an inline sensor according to the exemplary embodiment of the present invention.

As shown in FIG. 3, the inline sensor 200 is equipped with an illuminating unit 202 that emits light to the recording medium P having images recorded thereon, an imaging unit 208 having the imaging optical system 206, and a setting unit 210 where various criteria are set for use of the inline sensor 200 and for calibration. The imaging optical system 206, being an example of a light-receiving member, receives the light emitted from the illuminating unit 202 and reflected by the recording medium P and forms images on the CCD sensor 204. The CCD sensor 204 is configured to receive the light reflected by the recording medium P and to detect graphical content (images) or the recording medium P itself according to the intensity of the light.

The light from the recording medium P described herein includes the reflected light which has been reflected by the recording medium P and transmitted light which has transmitted through the recording medium P, and in broader terms, any light is included by which information regarding the images formed on the recording medium P, and positions or shapes of the recording medium P, can be detected. Additionally, the transmitted light described herein includes light that passes through an imaging lens or the like and light that passes through a window glass or the like. Furthermore, the detection of the recording medium P described herein includes detection of the position and the shape of the recording medium P.

The illuminating unit 202 is placed at an upper side of the conveying path 60 of the recording medium P and contains a pair of lamps 212 emitting the light toward the recording medium P. Each lamp 212 is a xenon lamp which is longitudinal in the Z direction. The length of the illumination range is larger than the largest width of the recording medium P to be carried. The pair of lamps 212 is placed symmetrically about an optical axis OA (intended optical axis) of the light reflected by the recording medium P and traveling toward the imaging unit 208. More specifically, each of lamps 212 is placed symmetrically about the optical axis OA such that the respective illumination angle thereof to the recording medium P is from 45 degrees to 50 degrees.

In detail, the pair of lamps 212 is equipped with a first lamp 212A provided at the upstream side in the conveying direction of the recording medium P, and a second lamp 212B provided at the opposite side from the first lamp 212A with respect to the optical axis OA. A detection unit 207 is configured as an example of detection section and includes the CCD sensor 204, the lamps 212 and a window glass 286 as an example of a transmission member which will be described below. The images on the conveyed recording medium P are detected by the detection unit 207.

The imaging optical system 206 is equipped with, as a main part thereof, a first mirror 214 reflecting the light guided along the optical axis OA in the X direction (in this embodiment, a direction toward the downstream side in the conveying direction of the recording medium P), a second mirror 216 reflecting the light reflected by the first mirror 214 to the upper side, a third mirror 218 reflecting the light reflected by the second mirror 216 to the upstream side in the conveying direction of the recording medium P, and lens 220 focusing the light reflected by the third mirror 218 on the CCD sensor 204 (forming an image). The CCD sensor 204 is placed at the upstream side in the conveying direction of the recording medium P with respect to the optical axis OA.

The length of the first mirror 214 along the Z direction is set to be larger than the largest width of the recording medium P. Furthermore, the first mirror 214, the second mirror 216 and the third mirror 218 are configured to reflect the light reflected by the recording medium P and entered to the imaging optical system 206 while narrowing down the light in the Z direction (main scanning direction) respectively. This configuration allows the reflected light from each part in the width direction of the recording medium P to be incident on the lens 220 having a cylindrical shape.

According to the configuration described above, in the inline sensor 200, the CCD sensor 204 is configured to output (feed back) signals in accordance with the imaged light, that is, the image density, toward the control device 192 (refer to FIG. 1) provided in the first processing unit 10A of the image forming apparatus 10. The control device 192 is configured to correct the image formed at the image forming unit 16 based on the signal from the inline sensor 200. Furthermore, in the image forming apparatus 10, the intensity of the irradiated light by the exposure device 40, the position of formed images or the like are corrected based on the signal from the inline sensor 200.

A light quantity diaphragm unit 224 is provided between the third mirror 218 and the lens 220 in the imaging optical system 206. The light quantity diaphragm unit 224 is configured to cross an optical path in the Z direction and to narrow down an amount of the light, which forms an image on the CCD sensor 204, in the Y direction (the direction intersecting with the main scanning direction). The amount of narrowing of the light quantity can be changed by operation from the outside. With respect to the light quantity by the light quantity diaphragm unit 224, it is configured such that the amount of the light for forming images on the CCD sensor 204 is adjusted to be a predetermined value, even if the amount of luminescence by each lamp 212 is changed due to aging of the lamps 212.

The setting unit 210 includes a reference roll 226 longitudinally elongated in the Z direction. The reference roll 226 has a detection reference surface 228, an evacuation surface 230, a color reference surface 234, white reference surfaces 232 and a composite test surface 236. The detection reference surface 228 is directed to face the conveying path 60 side when performing image detection of the recording medium P, and the evacuation surface 230 is directed to face the conveying path 60 side when the image detection is not performed for the recording medium P by the inline sensor 200. A multi-color pattern is formed along a longitudinal direction of the color reference surface 234. Plural test patterns are formed on the composite test surface 236. In this embodiment, the reference roll 226 is formed in a polygonal and cylindrical shape in which eight or more surfaces are formed in a circumferential direction. One each of the detection reference surface 228, the evacuation surface 230, the color reference surface 234 and the composite test surface 236 is provided, and two of the white reference surfaces 232 are provided around the circumference of the reference roll 226.

The reference roll 226 is configured so that it switches the surface facing the conveying path 60 by being rotated about a rotation axis 226A. The switching of the surface of the reference roll 226 is performed by a control circuit (not shown) provided in a circuit substrate 262 which will be described later. Further, by forming the polygonal and cylindrical shape of the reference roll 226 with at least eight sides, the dimensional difference between the center in the circumferential direction and both corner parts of each surface with respect to the center of rotation of the reference roll 226 is kept small. Therefore, while the distance between each surface of the reference roll 226 and an illuminating position of each lamp 212 (window glass 286 which will be described later) is made small, the corner parts of each surface of the reference roll 226 do not cause interference with the illuminating unit 202.

With respect to the detection reference surface 228, a length thereof in the circumferential direction is smaller than that of the other surfaces, and is smaller than a length of the window glass 286 in the conveying direction of the recording medium P. Adjacent surfaces of the detection reference surface 228 in the circumferential direction are defined as guide surfaces 238 which do not function like the other reference surfaces described above. The detection reference surface 228 is defined as a position reference surface for positioning a surface to be detected (to be read) of the conveyed recording medium P with respect to the illumination position for each lamp 212.

A length of the evacuation surface 230 in the circumferential direction is larger than that of the other surfaces. When image detection of the recording medium P is not performed by the inline sensor 200, the evacuation surface 230 functions as a guide surface which guides the recording medium P, and a distance between the evacuation surface 230 and the center of the rotation axis 226A is smaller than in the case of the detection reference surface 228. Accordingly, when image detection of the recording medium P is not performed by the inline sensor 200, a conveying path is formed at a larger distance from the illuminating unit 202 (the window glass 286) than when the image detection is performed by the inline sensor 200.

The white reference surfaces 232 are used for calibration of the imaging optical system 206, and a reference white film is attached to each of the surfaces 232 for outputting a predetermined signal from the imaging optical system 206. The color reference surface 234 is also used for calibration of the imaging optical system 206, and a film having patterns of reference colors corresponding to each color is attached to the surface 234.

Figure 6:
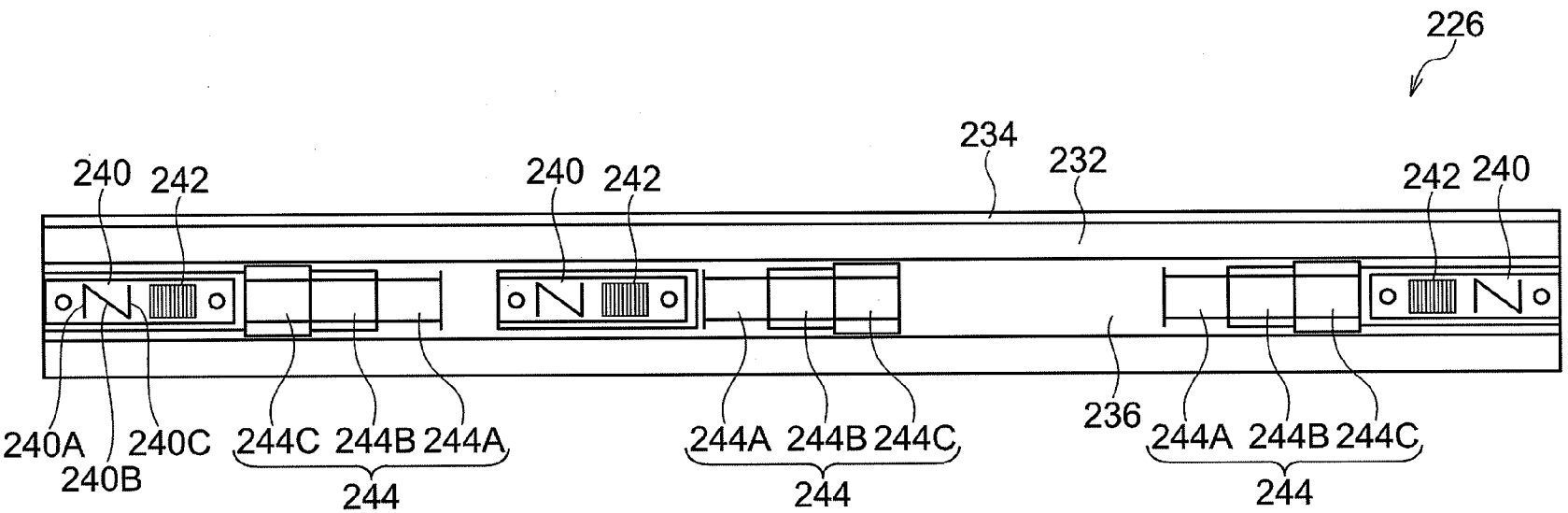
FIG. 6 is a schematic diagram of a composite test surface according to the exemplary embodiment of the present invention.

As shown in FIG. 6, the composite test surface 236 is provided so that a position alignment pattern 240 for calibrating the position of the reference roll 226 in a rotation direction (conveying direction of the recording medium P), a focus detecting pattern 242, and a depth detecting pattern 244 are arranged on the same surface 236.

The position alignment pattern 240 is configured by attaching a white film on which a black N-shaped pattern is formed such that the two vertical lines of the N-shape are indicated along the conveying direction of the recording medium P. The focus detecting pattern 242 is configured by attaching a white film on which a ladder pattern is formed, the ladder pattern having a number of black straight lines in parallel along the conveying direction of the recording medium P.

The depth detecting pattern 244 is configured to have a sheet member attached thereon. On the sheet member, three white surfaces 244A, 244B and 244C are arranged in a staircase pattern in the longitudinal direction of the composite test surface 236 (the direction of the rotation axis of the reference roll 226). Respective distances from the rotation axis 226A (refer to FIG. 2) of the reference roll 226 toward the three white surfaces are different.

At least one position alignment pattern 240 is provided at each end in the longitudinal direction of the composite test surface 236. The focus detecting pattern 242 is arranged adjacent to the position alignment pattern 240. The focus detecting pattern 242 is positioned at a center side of the position alignment pattern 240 in the longitudinal direction of the composite test surface 236. A total of three depth detecting patterns 244 are provided at both end sides and a center part in the longitudinal direction of the composite test surface 236. Further, in this embodiment, one position alignment pattern 240 and one focus detecting pattern 242 are provided between the depth detecting patterns 244 arranged at the center part and at either one end in the longitudinal direction of the composite test surface 236.

Next, a procedure of calibration of the CCD sensor 204 will be described.

As shown in FIG. 3, first, the white reference surface 232 is directed to face the conveying path 60 of the recording medium P. Then, the CCD sensor 204 outputs a shading compensation signal for compensating distribution of the light quantity in the Z direction (main scanning direction). Subsequently, the composite test surface 236 is directed to face the conveying path 60, and a detection position for the recording medium P in the conveying direction by the CCD sensor 204 is automatically adjusted with the position alignment pattern 240. That is, by detecting the N-shaped pattern in the Z direction (main scanning direction), the diagonal part 240B between the two straight line parts 240A and 240C is detected as shown in FIG. 6. Then, the reference roll 226 is rotated so that a distance between the straight line part 240A and the diagonal part 240B equals a distance between the straight line part 240C and the diagonal part 240B, and the detection position is adjusted.

Subsequently, after the detection position of the recording medium P in the conveying direction is adjusted, a focal point of the CCD sensor 204 is checked with the focus detecting pattern 242 (refer to FIG. 6), and an illumination depth is checked with the depth detecting pattern 244. Further, the color reference surface 234 is directed to face the conveying path 60. Then, the CCD sensor 204 is automatically adjusted so that signals of predetermined intensities are output for each of the colors.

The calibration of the CCD sensor 204 described above is performed, for example, when the image forming apparatus 10 is turned on (about once a day). On the other hand, calibration of the image forming apparatus 10 based on signals output from the CCD sensor 204 is performed, for example, each time that a job in which a predetermined number of images are formed on the recording medium P is finished (about ten times a day).

(Configuration of the Inline Sensor 200)

As shown in FIG. 3, the inline sensor 200 described above is configured to be dividable into three parts, being a center unit 246 having the illuminating unit 202 as a main part, an upper unit 248 having the imaging unit 208 as a main part, and a lower unit 250 having the setting unit 210 as a main part.

The upper unit 248 is configured to be detachable from the second processing unit 10B (refer to FIG. 1) of the image forming apparatus 10 by sliding in the Z direction. The center unit 246 is configured to be detachable from the upper unit 248 by sliding in the Z direction. The lower unit 250 is configured to be detachable from the center unit 246 and the upper unit 248 by sliding in the Z direction. The lower unit 250 which is located at the lower side of the conveying path 60 of the recording medium P is supported by a lower side drawer (not shown). The lower side drawer is drawn to the front side in the Z direction from the second processing unit 10B in order to free a jammed recording medium P. The lower unit 250 is removed from and fitted to the center unit 246 and the upper unit 248 by taking this lower side drawer in and out. The respective configurations will be described in detail below.

(Configuration of the Upper Unit 248)

The upper unit 248 includes an upper housing 254. The upper housing 254 accommodates the imaging unit 208 and a circuit substrate 262 described below, and forms a cooling duct 265 or the like. The upper housing 254 is further configured so as to include an imaging system housing 256 which accommodates the CCD sensor 204 and the imaging optical system 206.

The imaging system housing 256 is formed in a substantially rectangular box shape longitudinally elongated in the X direction, and houses the CCD sensor 204 at one end part in the X direction (in this embodiment, an end of the upstream side in the conveying direction of the recording medium P). Moreover, the second mirror 216 and the third mirror 218 are arranged at the other end in the X direction of the imaging system housing 256. At a substantially central part in the X direction of the imaging system housing 256, a window portion 256A is provided on which light is incident along the optical axis OA. The imaging system housing 256 is provided with the optics chamber 205, which houses the CCD sensor 204 or the like, and the inside of the imaging system housing 256 is a sealed (airtight) space as the window portion 256A is closed by a light transmissive window glass 258.

Moreover, the upper housing 254 has an upper cover 260 which covers the imaging system housing 256 from the upper side. A substrate chamber 264 in which the circuit substrate 262 is housed is formed between the upper cover 260 and an upper wall 256U of the imaging system housing 256. A duct 265 is formed with a duct cover 268 outside of the one end part in the X direction of the imaging system housing 256 where the CCD sensor 204 is located. The duct cover 268 covers the above-described end part of the imaging system housing 256 from the upstream side and the downstream side in the conveying direction of the recording medium P, thereby forming the duct 265 which is L-shaped in X-Y cross section.

Figure 4:
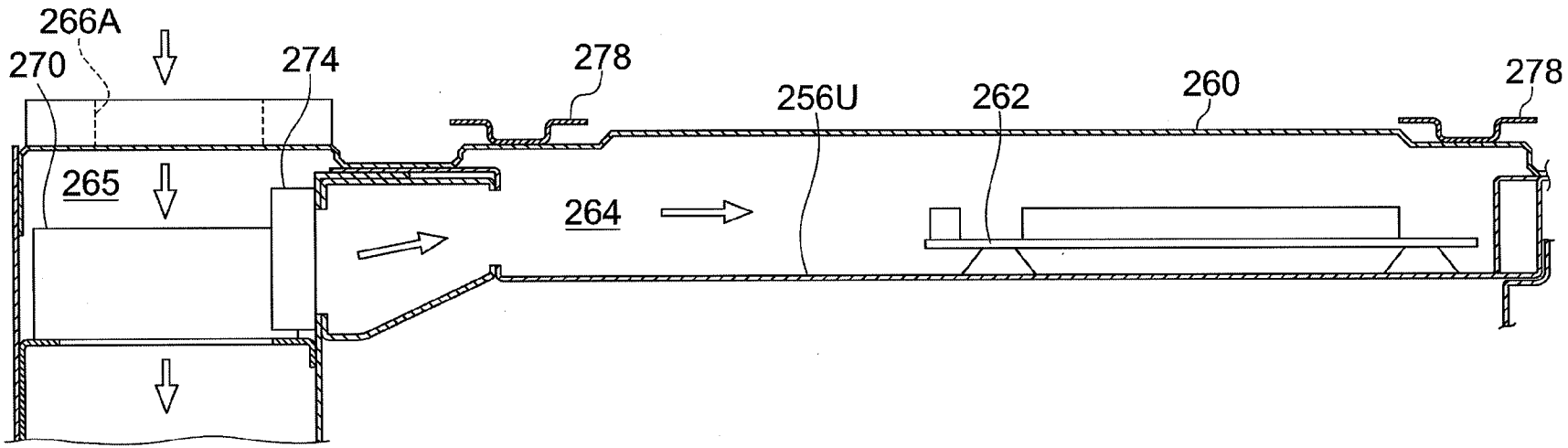
FIG. 4 is an explanatory diagram showing a state in which air is sent into a substrate chamber according to the exemplary embodiment of the present invention.

An upper end of the duct 265 is provided as an air inlet 266A, and the end part facing the air inlet 266A of the duct 265 is provided as a connecting port 266B which is connected with a duct 308 of a lamp housing 284 which is described below. In the duct 265, a fan 270 is provided and generates airflow in the duct 265 from the upper side to the lower side. Moreover, in the duct 265, a fan 272 which sends air into the optics chamber 205 (causes the inside of the optics chamber 205 to have positive pressure) is provided. Further, in the duct 265, a fan 274 which sends air into the substrate chamber 264 is provided (refer to FIG. 4).

Furthermore, the upper housing 254 includes a cover 275 which covers the imaging system housing 256 from the second mirror 216 and the third mirror 218 sides. An insulating space 276 is formed between the cover 275 and the imaging system housing 256. Sliders 278 having a longitudinal direction in the Z direction are provided in the upper housing 254. In this embodiment, a pair of sliders 278 is provided in parallel in the X direction on the upper cover 260. Each of the sliders 278 is fitted to a rail provided on the frame (not shown) of the second processing unit 10B. Each of the sliders 278 moves while being guided by the rail whereby the upper unit 248 moves in the Z direction with respect to the second processing unit 10B.

(Configuration of the Center Unit 246)

As shown in FIG. 3, the center unit 246 has a lamp housing 284 which accommodates the pair of lamps 212, a window glass 286 through which the light illuminated from the lamps 212 toward the recording medium P transmits, and a window cover 288 which holds the window glass 286. The window glass 286 is located between the conveying path 60 of the recording medium P and the lamps 212, and faces the conveying path 60. The lamp housing 284 is formed in a box shape and top and bottom sides thereof are open. An opening at the upper side is closed by the upper housing 254 and an opening at the lower side is closed by the window cover 288.

The illuminating unit 202 is configured so that the light emitted by each lamp 212 is irradiated onto the recording medium P through the window glass 286, and the light reflected at the recording medium P is incident into the lamp housing 284 through the window glass 286 along with the optical axis OA. The light reflected from the recording medium P and incident into the lamp housing 284 is guided to the imaging unit 208 through the window glass 258 of the imaging system housing 256 which is part of the imaging unit 208.

The lamp housing 284 includes a pair of sliders 290 which is projected in the X direction in a flange shape from an opening edge of the upper side and is longitudinally extended in the Z direction. The sliders 290 are fitted to a rail 292 formed on the upper housing 254. Each slider 290 moves while being guided by the rail 292, whereby the lamp housing 284 is attached to and detached from the upper housing 254 (the upper unit 248) in the Z direction.

The window cover 288 is configured so that an edge thereof and an edge of the window glass 286 do not face the upstream side in the conveying direction of the recording medium P. Both ends in the longitudinal direction of the window glass 286 are pressed and attached to the window cover 288 by attachment springs (not shown) in a position for closing a window part 288A provided at the window cover 288. That is, the window glass 286 is detachably fitted to the window cover 288.

The window cover 288 is detachably attached to the lamp housing 284. Specifically, the window cover 288 is configured so that the cross-sectional shape taken along the X-Y direction is a U-shape which opens at an upper side, and provided with a pair of sliders 298 at opening edge parts. The sliders 298 are fitted into rails 300 formed on the lamp housing 284. Each slider 298 moves while being guided by the rail 300 whereby the window cover 288 can be removed in the Z direction from the window glass 286. Accordingly, in the inline sensor 200, the window cover 288 can be exchanged and cleaned separately.

While not shown in the drawings, the center unit 246 and the upper unit 248 are configured so as to be positioned with a high degree of accuracy in each of the X, Y and Z directions by combinations of holes and pins which are connected and disconnected according to relative movement in the Z direction of the center unit 246 and the upper unit 248. Moreover, the upper unit 248 and a casing of the second processing unit 10B (refer to FIG. 1) are configured so as to be positioned with a high degree of accuracy in each of the X, Y and Z directions by combinations of holes and pins which are connected and disconnected according to relative movement in the Z direction of the upper unit 248 and the casing of the second processing unit 10B.

(Configuration of the Lower Unit 250)

As shown in FIG. 3, the lower unit 250 includes a lower housing 302 which accommodates the reference roll 226 and a motor (not shown) driving the reference roll 226. The lower housing 302 is supported by the lower side drawer as described above, and the position thereof in the Z direction is defined by the lower side drawer. Moreover, the lower unit 250, the center unit 246 and the upper unit 248 are configured so as to be positioned with a high degree of accuracy in each of the X and Y directions by combinations of holes and pins which are connected and disconnected according to relative movement in the Z direction of the lower unit 250, the center unit 246 and the upper unit 248. In this configuration, the position of the lower unit 250 in each of the X, Y and Z directions with respect to the center unit 246 and the upper unit 248 is determined while the conveying path 60 of the recording medium P is located between the center unit 246 and the lower unit 250.

(Countermeasures Against Stray Light)

As shown in FIG. 3, in the lamp housing 284, a baffle 304 is provided at an upper part of the pair of lamps 212 (212A, 212B) so as to surround the optical axis OA. The baffle 304 has at least a pair of sidewalls 304S and a bottom wall 304B. In this embodiment, the pair of sidewalls 304S are connected with a pair of front and back walls (not shown) which are opposed in the Z direction. Moreover, a lower side window 304W is provided at the bottom wall 304B, the optical axis OA passing therethrough. An upper opening end of the baffle 304 surrounds the window part 256A of the imaging system housing 256. Therefore, the light which travels along with optical axis OA enters into the imaging unit 208 via an inside of the baffle 304.

The dimensions and shape of the baffle 304 are set so that light emitted from the back side of each lamp 212 may not reach the window portion 256A. That is, the position of the opening edge of the lower side window 304W is set so that light emitted from the back side of each lamp 212 may not reach the window portion 256A directly. An angle of inclination of the side wall 304S with respect to the optical axis is set so that light emitted from the back side of each lamp 212 does not reach the window portion 256A even if the light is reflected on the side wall 304S.

In the imaging system housing 256, plural partition walls 306 are disposed which divide off areas other than the light conduction path formed by the imaging optical system 206. Each partition wall 306 has an aperture 306A for an optical passage, and the size (upper limit) of the aperture 306A is decided depending on the diffusion angle of the reflected light such that diffusion light reflected by the recording medium P is not narrowed in the Y direction and the Z direction.

(Airflow)

As shown in FIG. 3, in the lamp housing 284, the duct 308 is formed by one of the side walls 304S (in this embodiment, the upstream side in the conveying direction of the recording medium P) and a peripheral wall of the lamp housing 284. The upper opening end of the duct 308 is connected to the duct 265 through the connection port 266B in a state in which the lamp housing 284 is fitted to the upper housing 254. Accordingly, airflow generated by a fan 270 is introduced into the lamp housing 284.

An air outlet 310 is formed at a peripheral wall which is provided at an opposite side of the duct 308 in the X direction of the lamp housing 284. Therefore, the airflow from the duct 265 runs through the first lamp 212A at the upstream side and the second lamp 212B at the downstream side in the conveying direction of the recording medium P while being guided by the peripheral wall of the lamp housing 284 and the window cover 288, and is discharged to the outside of the lamp housing 284 through the air outlet 310.

Moreover, an overhang portion 312, for preventing the light emitted from the back side of the first lamp 212A from reaching the lower side window 304W, is projected from the lower end of the sidewall 304S which forms part of the duct 308. The amount of projection of the overhang portion 312 is set so that the cooling effect of the airflow to each of the pair of lamps 212 becomes equivalent.

(Light Quantity Diaphragm Unit)

As shown in FIG. 3, the light quantity diaphragm unit 224 has a sidewall 224S, an upper wall 224U and a lower wall 224L, and a cross-sectional shape taken along X-Y directions thereof is formed to be a U-shape which opens toward the third mirror 218 side. A substantially rectangular opening part 314 is formed in the sidewall 224S of the light quantity diaphragm unit 224. Moreover, a rib 316 is formed downward from an end part of the upper wall 224U. Thereby, the light quantity diaphragm unit 224 is configured so as to interfere with the light from the recording medium P at a lower edge 314L of the opening part 314 and at a lower end 316L of the rib 316 thereby narrowing the light quantity in the Y direction.

One end in the longitudinal direction of the light quantity diaphragm unit 224 reaches a wall at the front side of the imaging system housing 256, and an adjusting lever (not shown) is attached to the one end of the light quantity diaphragm unit 224 through an operation hole formed in the wall. The light quantity diaphragm unit 224 is rotated with operation of the adjusting lever and moves from an initial position in which the light quantity is most narrowed to a position in which narrowing of the light quantity is decreased gradually.

(Jamming Suppression Structure)

Figure 5:
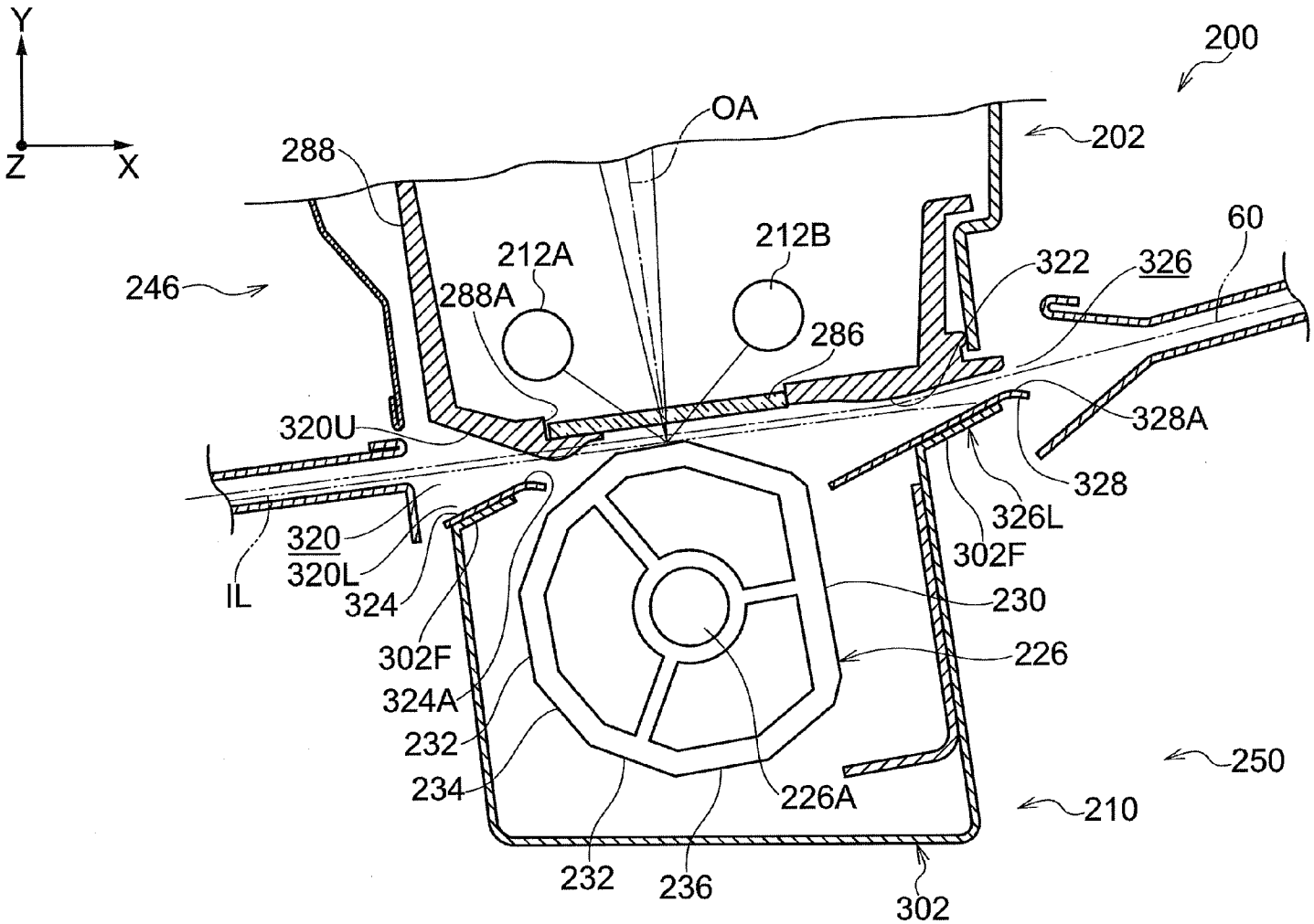
FIG. 5 is a magnified cross-sectional view of a recording medium conveying path portion of the inline sensor according to the exemplary embodiment of the present invention.

As shown in FIG. 5, the conveying path 60 between the center unit 246 (the illuminating unit 202) and the lower unit 250 (the setting unit 210) is configured so that the elevation thereof becomes higher toward the downstream side in the conveying direction of the recording medium P. For each corner part of the first window cover 288 and the lower housing 302, a chamfering or a round processing is carried out whereby an entrance chute 320 which is an inducing part facing the upstream side in the conveying direction of the recording medium P is formed at the upstream side of the window glass 286.

An upper chute 320U which constitutes an upper part of the entrance chute 320 has a smooth surface which is downwardly convex. Assuming that an imaginary line extended from the detection reference surface 228 is IL, when viewed in the Z direction in a state in which the detection reference surface 228 of the reference roll 226 faces the conveying path 60 side of the recording medium P, the dimensions and shape of the upper chute 320U are set so as to interfere with the extension line IL (so that a projected end of the upper chute 320U is positioned at a lower side of the extension line IL).

A lower chute 320L which constitutes a lower part of the entrance chute 320 is brought close to the reference roll 226 by a lower chute member 324 fixed to a flange 302F which is extended inward from the opening end of the lower housing 302. Further, the downstream end in the conveying direction of the recording medium P in the lower chute member 324 is formed as a round part 324A which is upwardly convex.

An exit chute 326 is formed at the downstream side in the conveying direction of a convex part 322 of the window cover 288. The exit chute 326 is formed between a portion located at the downstream side of the convex part 322 and the lower housing 302. The lower chute 326L which constitutes a lower part of the exit chute 326 is provided by fixing a lower chute member 328 to a flange 302F which is extended outward from the opening end of the lower housing 302. Further, a downstream end in the conveying direction of the recording medium P of the lower chute member 328 is formed as a round part 328A which is upwardly convex.

When detecting an image with the CCD sensor 204, the detection reference surface 228 of the reference roll 226 is directed to face the recording medium P side with a posture substantially parallel to the window glass 286. The respective guide surfaces 238 provided at either side of the detection reference surface 228 receive the recording medium P from the entrance chute 320, and guides the recording medium P toward the exit chute 326.

When the image is not detected by the CCD sensor 204, the evacuation surface 230 of the reference roll 226 faces the recording medium P side with a posture whereby the evacuation surface 230 becomes closer to the window glass 286 the further it extends toward the downstream side in the conveying direction of the recording medium P (non-parallel posture). The evacuation surface 230 is configured as a wide surface which extends from the round part 324A of the lower chute member 324 to the vicinity of the exit chute 326. The evacuation surface 230 receives the recording medium P from the entrance chute 320 and guides the recording medium P toward the exit chute 326 according to the above-mentioned posture.

(Function of the Inline Sensor 200)

As shown in FIG. 3, the inline sensor 200 illuminates light using the pair of lamps 212 onto the recording medium P which passes through between the illuminating unit 202 and the setting unit 210. Then, the light reflected by the recording medium P is guided to the imaging unit 208 along the optical axis OA, and is imaged on the CCD sensor 204 by the imaging optical system 206. Subsequently, the CCD sensor 204 outputs a signal according to an image density for every position of the formed image to the control device 192 (refer to FIG. 1) of the image forming apparatus 10. Then, in the control device 192, the image concentration and an image forming position or the like are modified based on the signal from the CCD sensor 204.

When performing the calibration of the CCD sensor 204, first, the motor of the lower unit 250 operates and the white reference surface 232 is directed to face the conveying path 60 of the recording medium P. Then, the CCD sensor 204 is adjusted so as to output a predetermined signal.

Subsequently, the composite test surface 236 (refer to FIG. 6) is directed to face the conveying path 60, and the detection position of the CCD sensor 204 is adjusted so that the respective intervals between the diagonal part 240B and the straight line part 240A and between the diagonal part 240B and the straight line part 240C of the position alignment pattern 240 (refer to FIG. 6) become equal. Next, the focus state of the CCD sensor 204 is checked using the focus detecting pattern 242. Moreover, the illumination depth is checked using the depth detecting pattern 244. Furthermore, the color reference surface 234 (refer to FIG. 6) is directed to face the conveying path 60. The CCD sensor 204 is adjusted so as to output the predetermined signal for each color.

(Configuration of Main Components)

Next, the details of the detection unit 207 and the reference roll 226 of the inline sensor will be explained.

Figure 7A:
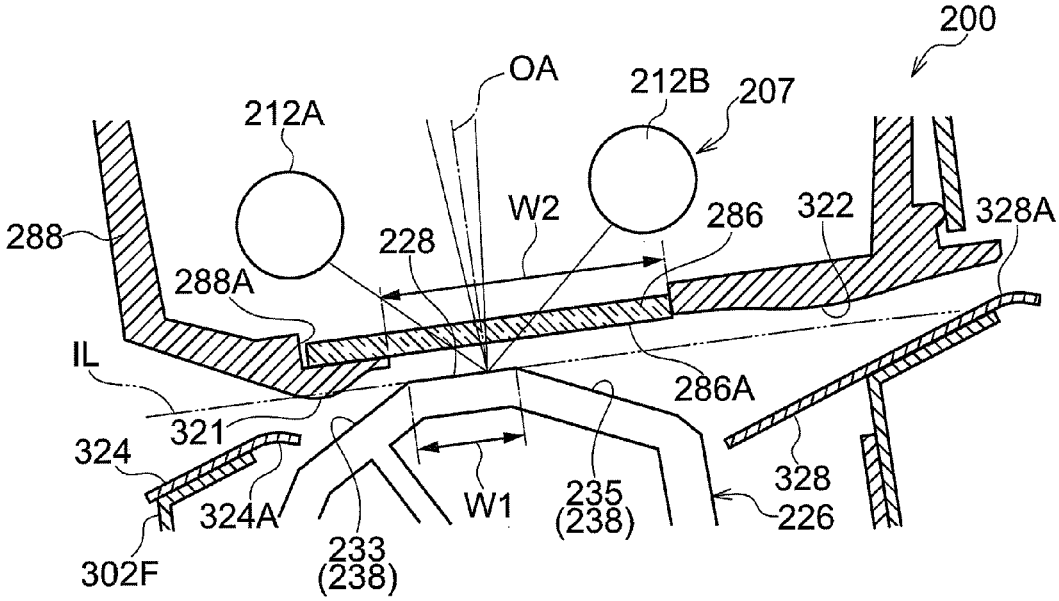
FIG. 7A is a cross-sectional view showing a detection surface, a detection reference surface and a positional relationship of respective convex parts according to the exemplary embodiment of the present invention.

As shown in FIG. 7A, the detection unit 207 of the inline sensor 200 has the window cover 288 as an example of a casing for supporting the window glass 286, and an exposed portion at the lower surface of the window glass 286 is designated as a detection surface 286A. At the upstream side (the left hand side in the figure) and the downstream side (the right hand side in the figure) in the conveying direction of the recording medium P with respect to the detection surface 286A, the convex parts 321 and 322, which are examples of projecting sections, project further toward the recording medium P side than the detection surface 286A (refer to FIG. 8B).

When viewed from a direction intersecting the conveying direction of the recording medium P, the top part (lower end in the figure) of the convex part 321 projects across the extension line IL from the detection reference surface 228 toward the reference roll 226 side. In addition, the top part (lower end in the figure) of the convex part 322 projects toward the lower chute member 328. Note that the convex parts 321 and 322 are integrally formed at the window cover 288.

In the inline sensor 200, the reference roll 226 having plural surfaces in the conveying direction of the recording medium P (not shown in FIG. 7) is provided, as an example of an opposing member, so as to face the detection surface 286A (at the opposite side of the conveying path 60 to the window glass 286). The reference roll 226 has the reference detection surface 228, as an example of an opposing surface, which is one of the plural surfaces, as described above. The reference detection surface 228 is placed facing the detection surface 286A. In the conveying direction of the recording medium P, the length W1 of the reference detection surface 228 is shorter than the distance between the convex part 321 and the convex part 322, and shorter than the length W2 of the detection surface 286A. The detection surface is defined as a surface including an area where the window glass 286 is exposed and a continuous surface to the upstream side or to the downstream side from the exposed area in the conveying direction of the recording medium P. In this embodiment, the detection surface 286A is formed only by the area where the window glass 286 is exposed, and the length W2 coincides with the length of the detection surface 286A. The continuous surface described above can be provided at either one of the downstream side and the upstream side, or at both sides.

The reference roll 226 has an upstream surface 233 of the guide surfaces 238 located at the upstream side of the detection reference surface 228 and gradually approaching the detection surface 286A as it extends toward the downstream side in the conveying direction, and the downstream surface 235 of the guide surfaces 238 located at the downstream side of the detection reference surface 228 and gradually diverging from the detection surface 286A as it extends toward the downstream side in the conveying direction. The upstream surface 233, the detection reference surface 228 and the downstream surface 235 are continuously formed in the circumferential direction of the reference roll 226.

Figure 7B:
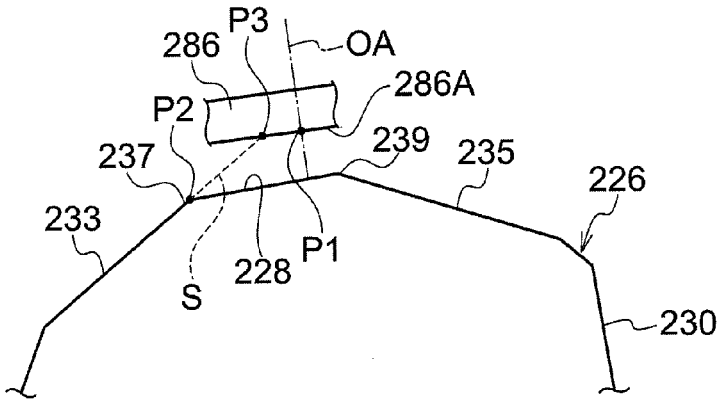
FIG. 7B is an exemplary diagram showing an outer shape of a reference roll according to the exemplary embodiment of the present invention.

Furthermore, as shown in FIG. 7B, in the reference roll 226, a boundary part 237 between the upstream surface 233 and the detection reference surface 228, and a boundary part 239 between the detection reference surface 228 and the downstream surface 235 are configured to have an arced shape as an example of a curved shape which is outwardly convex. The boundary parts 237 and 239 may be formed in chamfered shapes. A read position P1 for reading the image information on the recording medium P is set on the detection surface 286A, a boundary position P2 between the detection reference surface 228 and the upstream surface 233 is set at the upstream side in the conveying direction from the read position P1 in the reference roll 226.

The read position P1 is determined as a position where the optical axis OA intersects the detection surface 286A when viewing the window glass 286 from a direction perpendicular to the conveying direction. A position where an extension line S from the upstream surface 233 intersects with the detection surface 286A is defined as P3, and P3 is positioned at the upstream side from the read position P1 in the conveying direction of the recording medium P. The detection reference surface 228 is provided further the upstream side so that the length at the upstream side in the conveying direction of the detection reference surface 228 from the optical axis OA is longer than the length at the downstream side of the detection reference surface 228 from the optical axis OA.

As described above and shown in FIG. 7A, the lower chute member 328 is provided on the downstream side in the conveying direction of the detection surface 286A and of the reference roll 226, as an example of a guide member for guiding the recording medium P to the downstream side. The end portion of the lower chute member 328 at the downstream side is formed as a round part 328A curved in a direction diverging from the recording medium P.

Next, the operation of the present embodiment will be explained.

Figure 8A:
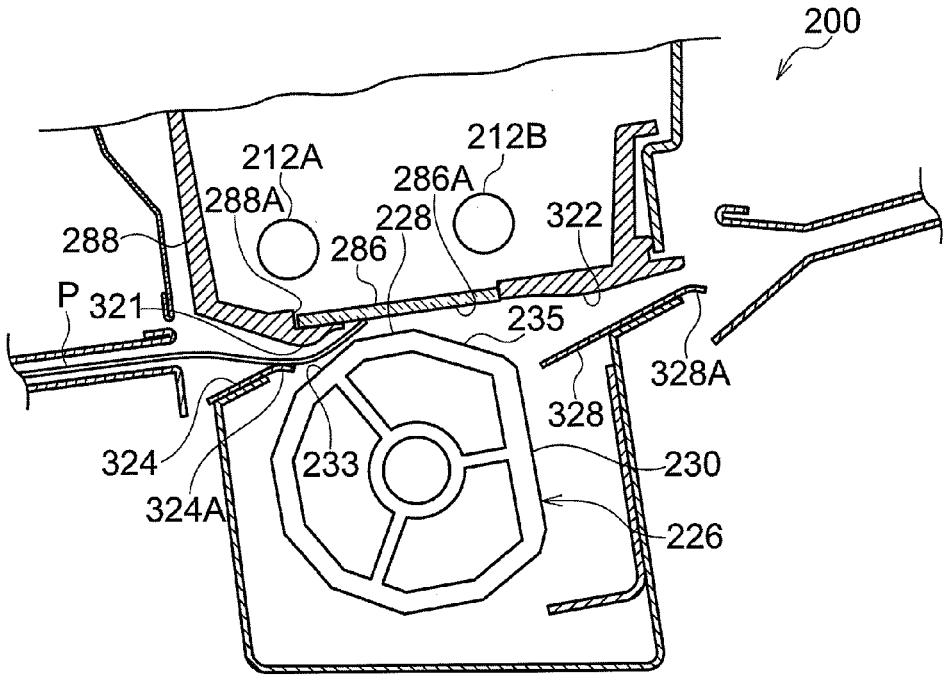
FIG. 8A and FIG. 8B are explanatory diagrams showing states in which an upward curling recording medium P is conveyed through the inline sensor according to the exemplary embodiment of the present invention.

First, as shown in FIG. 8A, a case will be explained in which the front part of the recording medium P conveyed to the inline sensor 200 curls in concave shape (a shape in which the front part is inclined upward along the conveying direction) when viewed from a direction perpendicular to the conveying direction.

The recording medium P conveyed to the inline sensor 200 contacts the convex part 321 as the front part of the recording medium P is diagonally curved upward. Accordingly, a force directed downward is applied to the front part of the recording medium P. Since the convex part 321 and the window cover 288 are integrally formed, the recording medium P does not enter into a space between the convex part 321 and the window cover 288, that may occur in a configuration in which the convex part 321 and the window cover 288 are provided separately. The positional accuracy of the convex part 321 is improved by forming these parts integrally.

Therefore, the recording medium P contacts the detection surface 286A in a state in which the front part is still inclined upward after crossing over the convex part 321. Thus, the recording medium P tends not to contact the detection surface 286A in planar contact but contacts the detection surface 286A in a state of essentially line contact. Thereby, a contact area between an image formed side of the recording medium P and the detection surface 286A is decreased. In addition, since the end portion on the downstream side of the lower chute member 324 is configured as the round part 324A, the possibility of the end portion of the lower chute member 324 contacting the recording medium P is decreased and the occurrence of scratches on the recording medium P is suppressed.

Then, although an upward force is applied to the front part of the recording medium P moving along the conveying direction as a result of contact with the detection reference surface 228, the length in the conveying path 60 (refer to FIG. 3) at which the upward force is applied is short because the length of the detection reference surface 228 is shorter than the length of the detection surface 286A. Thereby, the possibility of contact between the recording medium P and the detection surface 286A is decreased. Furthermore, since the downstream surface 235 is inclined downward toward the downstream side, the front part of the recording medium P that has moved over the detection reference surface 228 is bent downward by its own weight. Accordingly, the contact area of the recording medium P and the detection surface 286A is decreased.

Figure 8B:
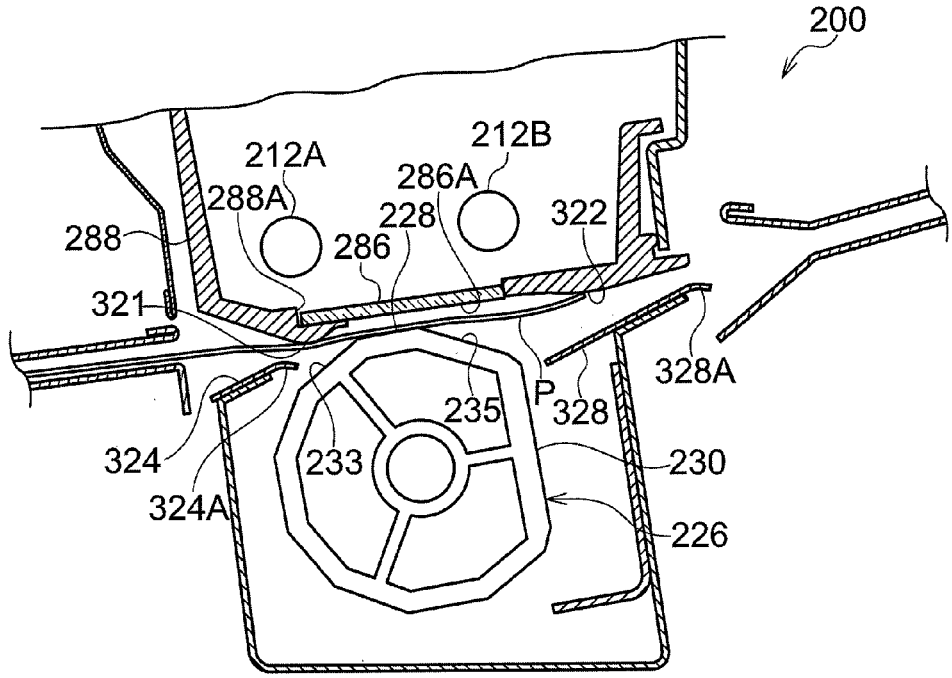

Then, as shown in FIG. 8B, a downward force is applied to the front part of the recording medium P as the front part contacts the convex part 322 as the recording medium P moves along the conveying direction toward the downstream side. For the recording medium P, since upward movement is prevented by the convex part 321 at the upstream side and by the convex part 322 at the downstream side of the detection surface 286A, planar contact between the recording medium P and the detection surface 286A is suppressed, that is, the contact area of the recording medium P is reduced, despite the existence of the detection reference surface 228 facing the detection surface 286A.

Moreover, in this state, the recording medium P is pressed down by the convex part 321 and the convex part 322, whereby a part of the recording medium P between the convex part 321 and the convex part 322 moves along the detection reference surface 228. Thus, bending of the recording medium P on the detection reference surface 228 is suppressed and the reading performance for images on the recording medium P passing above the detection reference surface 228 is improved.

Then, the front part of the recording medium P that has moved along the conveying direction contacts with the lower chute member 328 after passing beyond the convex part 322. Since the end portion at the downstream side of the lower chute member 328 is formed as the round part 328A, the end portion of the lower chute member 328 does not contact with the recording medium P, and scratches on the recording medium P are suppressed.

In this way, in the line sensor 200, the occurrence of the scratches or contamination on the detection surface 286A is suppressed as the contact area between the recording medium P and the detection surface 286A is decreased. Moreover, because the upstream surface 233, the detection reference surface 228 and the downstream surface 235 are formed in an overall continuous mound shape, and the length of the detection reference surface 228 is shorter than the length of the detection surface 286A, contact between the recording medium P and the detection reference surface 228 is reduced, and the load acting on the recording medium P when being conveyed is also reduced. Accordingly, conveying speed reduction of the recording medium P and jamming of the recording medium P are suppressed.

Furthermore, in the inline sensor 200, since respective boundaries (joints) between the upstream surface 233, the detection reference surface 228 and downstream surface 235 are formed with a curved shape, the occurrence of scratches on the recording medium P is suppressed in comparison with a configuration in which the boundaries are angled. In addition, in the inline sensor 200, as shown in FIG. 7B, since the boundary position P2 between the detection reference surfaces 228 and the upstream surface 233 is positioned at the upstream side in the conveying direction from the read position P1 of the detection surface 286A, the front part of the recording medium P contacts first at a region of the detection surface 286A at the upstream side of the read position P1. Accordingly, the occurrence of scratches at the read position P1 caused by the recording medium P is suppressed in comparison with a configuration in which the front part of the recording medium P contacts (collides) with the read position P1.

Figure 9A:
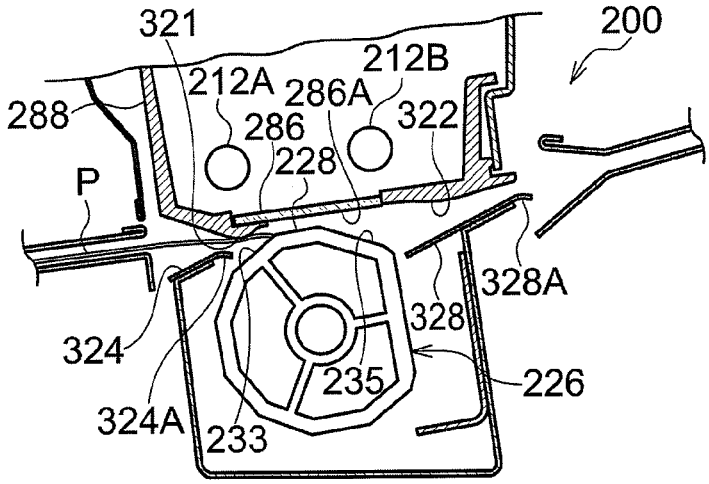
FIG. 9A, FIG. 9B and FIG. 9C are explanatory diagrams showing states in which a downward curling recording medium P is conveyed through the inline sensor according to the exemplary embodiment of the present invention.

Next, as shown in FIG. 9A, a case will be explained in which the front part of the recording medium P conveyed to the inline sensor 200 curls in convex shape (a shape in which the front part is inclines downward along the conveying direction) when viewed from a direction perpendicular to the conveying direction. Explanation of mechanisms similar to the case in which the front part of the recording medium P curls in a concave shape may be omitted.

Because the shape of the front part is inclined downward, the recording medium P conveyed to the inline sensor 200 contacts the lower chute member 324 and contacts the convex part 321 while moving upward. A downward force is applied to the front part of the recording medium P. Then, the recording medium P moves in the conveying direction such that the front part thereof passes the convex part 321.

Figure 9B:
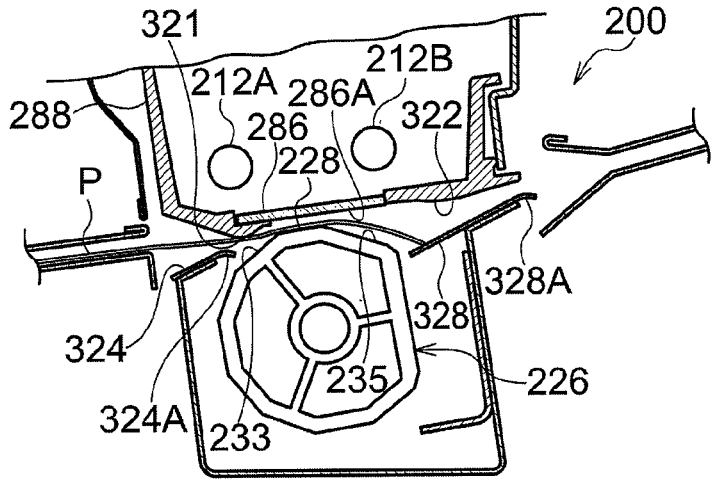

Next, as shown in FIG. 9B, although an upward force is applied to the front part of the recording medium P moved along the conveying direction due to contact with the detection reference surface 228, the period during which the upward force is applied is short because the length of the detection reference surface 228 is smaller than the length of the detection surface 286A. Accordingly, the period during which the recording medium P contacts the detection surface 286A is shortened. Furthermore, since the downstream surface 235 is inclined downward at the downstream side, the front part of the recording medium P that has moved along the detection reference surface 228 is further bent downward by its own weight. Accordingly, the contact area between the recording medium P and the detection surface 286A is further reduced. In addition, the front end of the recording medium P that has passed over the detection reference surface 228 contacts the lower chute member 328 and is guided to the downstream side.

Figure 9C:
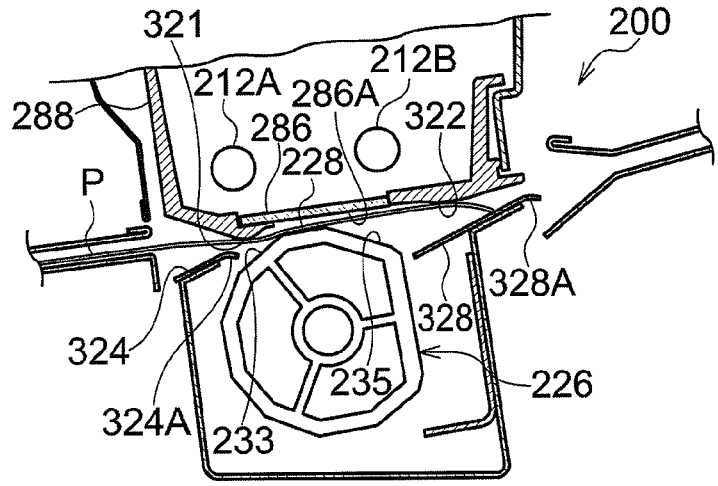

Next, as shown in FIG. 9C, a downward force is applied to the front part of the recording medium P due to contact of the recording medium P with the convex part 322 at the downstream side. With respect to the entire recording medium P, since upward movement is prevented by the convex part 321 at the upstream side and the convex part 322 at the downstream side of the detection surface 286A, planar contact of the recording medium P with the detection surface 286A is reduced, that is, the contact area of the recording medium P is decreased, despite the existence of the detection reference surface 228 facing the detection surface 286A.

Moreover, in this state, the recording medium P is pressed down by the convex part 321 and the convex part 322, whereby a part of the recording medium P between the convex part 321 and the convex part 322 moves along the detection reference surface 228. Thus, bending of the recording medium P on the detection reference surface 228 is suppressed and the reading performance for images on the recording medium P passing over the detection reference surface 228 is improved. Since the end portion at the downstream side of the lower chute member 328 is formed as the round part 328A, the end portion of the lower chute member 328 does not contact the recording medium P, and scratches on the recording medium P are suppressed.

As explained above, in the line sensor 200, the occurrence of the scratches or contamination on the detection surface 286A is suppressed even if the front part of the recording medium P curls diagonally downward. When conveying a recording medium P that does not exhibit curling, the extent of curling at the front part is smaller than the recording medium in FIG. 9B, and the states of the recording medium P are similar to those in FIG. 9A and FIG. 9C and, therefore, explanation thereof is omitted.

Furthermore, in the inline sensor 200, as shown in FIG. 7B, since the intersecting position P3 of the detection surface 286A and the extended line S from the upstream surface 233 is located at the upstream side of the read position P1 on the detection surface 286A in the conveying direction, the front part of the recording medium P first contacts a region of the detection surface 286A at the upstream side of the read position P1. Accordingly, paper dust adhering to the detection surface 286A is scraped off. In particular, when the front part of the recording medium P curls upward, more paper dust is scraped off.

Next, a modification of the inline sensor 200 of this embodiment will be explained.

It has been specified and explained that the projecting part 321 protrudes toward the reference roll 226 side crossing the extension line IL of the detection reference surface 228 in FIG. 7A. However, when defining a projection state of the projecting part 321 (or projecting part 322), in addition to above, the configuration may be such that the detection reference surface 228 is inclined (not parallel) with respect to the window glass 286 (detection surface 286A), the detection reference surface 228 has a curved surface, or the window glass 286 is inclined with respect to the horizontal plane and the detection reference surface 228 is inclined with respect to the window glass 286. These modifications will be explained as a first, a second, a third and a fourth modification. FIGS. 10, 11, and 12 used in explanation of a first to a sixth modifications are exemplary diagrams in which the main components of the inline sensor 200 are simplified.

Figure 10A:
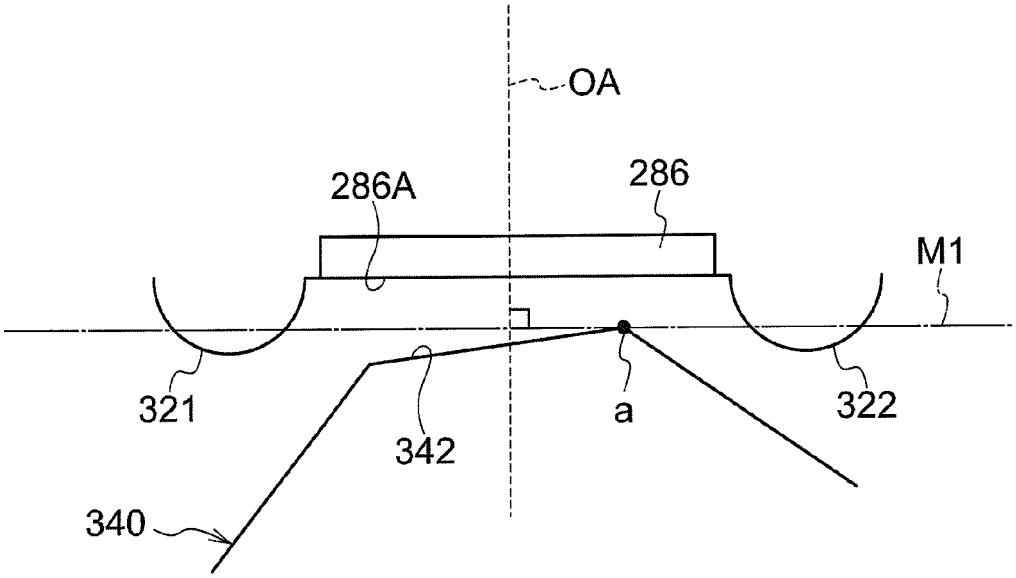
FIG. 10A is an exemplary diagram showing a first modification of a window glass, a convex part and a positional relationship of an opposing surface according to the exemplary embodiment of the present invention.

FIG. 10A shows, as the first modification, an arrangement of a reference roll 340 with the window glass 286, and the convex parts 321 and 322 in the inline sensor 200 of the first embodiment. The reference roll 340, as an example of an opposing member, is substituted for the reference roll 226 (refer to FIG. 7A). The reference roll 340 has plural surfaces including an opposing surface 342 having a surface direction that intersects the surface direction of the detection surface 286A of the window glass 286 when viewed from a direction intersecting the conveying direction of the recording medium P (not shown). The opposing surface 342 is formed to be inclined and a downstream end thereof is higher than an upstream end in the conveying direction of the recording medium P.

In the first modification, the convex parts 321 and 322 project toward the reference roll 340 side and cross an imaginary line M1 which passes through the closest point 'a' of the opposing surface 342 to the window glass 286 (right-hand end point of the opposing surface 342 in the drawing) and perpendicularly intersects the optical axis OA. When the recording medium P enters between the window glass 286 and the opposing surface 342 and subsequently moves to the downstream side, the recording medium P contacts the convex part 321 or the convex part 322 whereby a force toward the opposing surface 342 side acts on the recording medium P, and contact between the recording medium P and the detection surface 286A is suppressed.

Figure 10B:
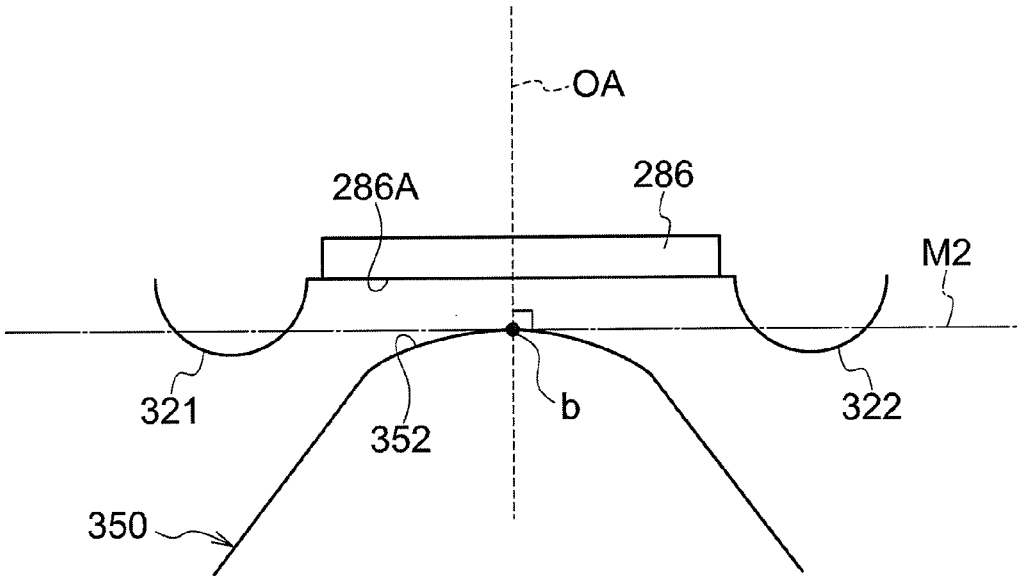
FIG. 10B is an exemplary diagram showing a second modification of the window glass, the convex part and the positional relationship of the opposing surface according to the exemplary embodiment of the present invention.

FIG. 10B shows, as the second modification, an arrangement of a reference roll 350 with the window glass 286 and the convex parts 321 and 322 in the inline sensor 200 of the first embodiment. The reference roll 340, as an example of an opposing member, is substituted for the reference roll 226. The reference roll 350 has plural surfaces including an opposing surface 352 which is a curved surface that is convexly curved towards the window glass 286 when viewed from a direction intersecting the conveying direction of the recording medium P (not shown). In the opposing surface 352, a point 'b', for example, is the closest point to the window glass 286 and is provided in the optical axis OA.

In the second modification, the convex parts 321 and 322 project toward the reference roll 350 side and cross an imaginary line M2 which passes through the intersecting point 'b' of the opposing surface 352 and the optical axis OA and is parallel to the window glass 286. When the recording medium P enters between the window glass 286 and the opposing surface 352 and subsequently moves to the downstream side, the recording medium P contacts the convex part 321 or the convex part 322, a force toward the opposing surface 352 side acts on the recording medium P and contact between the recording medium P and the detection surface 286A is suppressed.

Figure 11A:
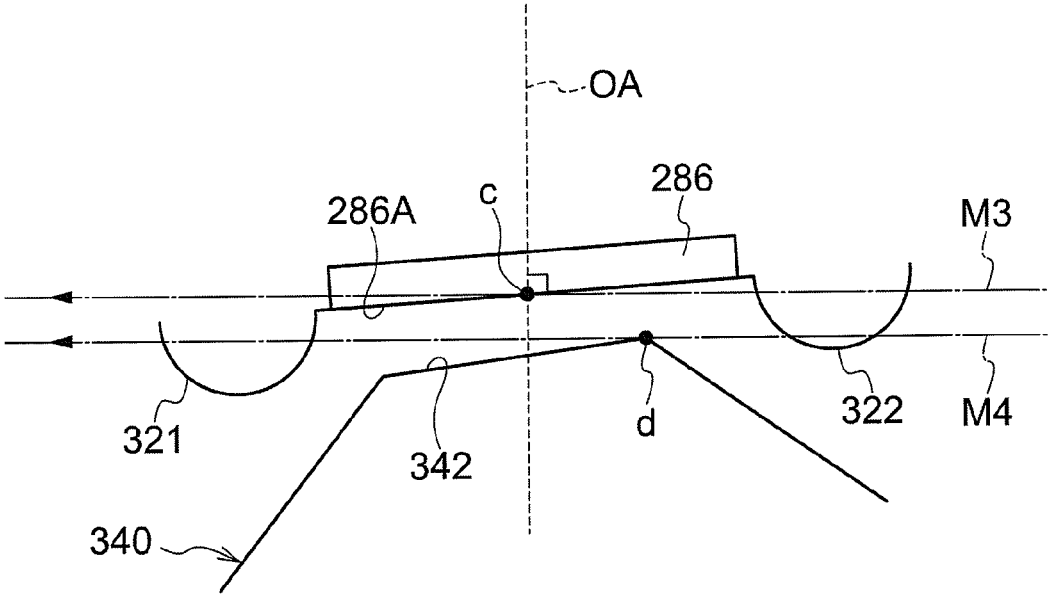
FIG. 11A is an exemplary diagram showing a third modification of the window glass, the convex part and the positional relationship of the opposing surface according to the exemplary embodiment of the present invention.

FIG. 11A shows, as the third modification, an arrangement of the reference roll 340 of the first modification, the window glass 286, which is inclined with respect to the horizontal direction, and the convex parts 321 and 322. The detection surface 286A of the window glass 286 is configured to be inclined such that an end part position thereof at the downstream side is higher than an end part position at the upstream side in the conveying direction when viewed from a direction intersecting the conveying direction of the recording medium P (not shown).

In the third modification, an imaginary line that passes through a point 'c' where the detection surface 286A intersects the optical axis OA and that perpendicularly intersects the optical axis OA is defined as M3, and a point in the opposing surface 342 which is closest to the line M3 is defined as "d". The convex parts 321 and 322 project toward the reference roll 340 side and cross an imaginary line M4 which passes through the point 'd' and is parallel to the line M3. When the recording medium P enters between the window glass 286 and the opposing surface 342 and subsequently moves to the downstream side, the recording medium P contacts the convex part 321 or the convex part 322, a force toward the opposing surface 342 side acts on the recording medium P and contact with the detection surface 286A is suppressed.

Figure 11B:
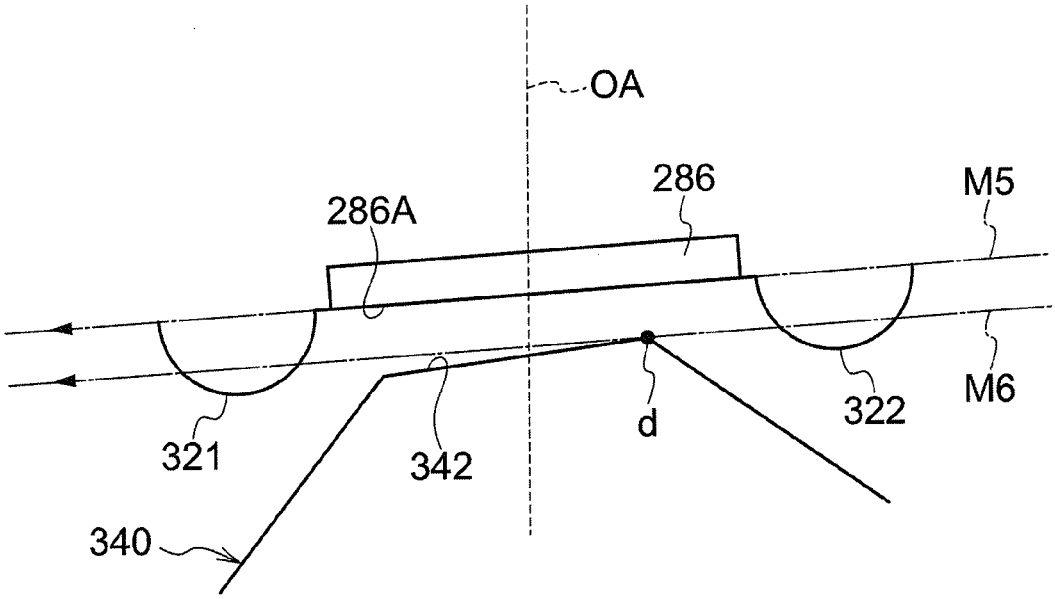
FIG. 11B is an exemplary diagram showing a fourth modification of the window glass, the convex part and the positional relationship of the opposing surface according to the exemplary embodiment of the present invention.

FIG. 11B shows, as the fourth modification, an imaginary line M6 which is a reference for the projection of the convex parts 321 and 322 and is determined by a different procedure from that of the line M4 in the third modification. In the fourth modification, an imaginary line extending from the detection surface 286A is defined as M5, and the closest point in the opposing surface 342 to the line M5 is defined as 'd'. The convex parts 321 and 322 project toward the reference roll 340 side and cross the line M6 which is parallel to the line M5 and passes through the point 'd'. When the recording medium P enters between the window glass 286 and the opposing surface 342 and subsequently moves to the downstream side, the recording medium P contacts the convex part 321 or 322, a force toward the opposing surface 342 side acts on the recording medium P, and contact with the detection surface 286A is suppressed.

The reason for specifying the point on the reference roll which is closest to the window glass 286 and the positions of the convex parts 321 and 322 is that the closest point of the opposing surface to the window glass 286 has the greatest effect the behavior and orientation of the recording medium P. That is, it is desirable that the convex parts 321 and 322 project further toward the reference roll side than the closest point of the opposing surface to the window glass 286.

Figure 12A:
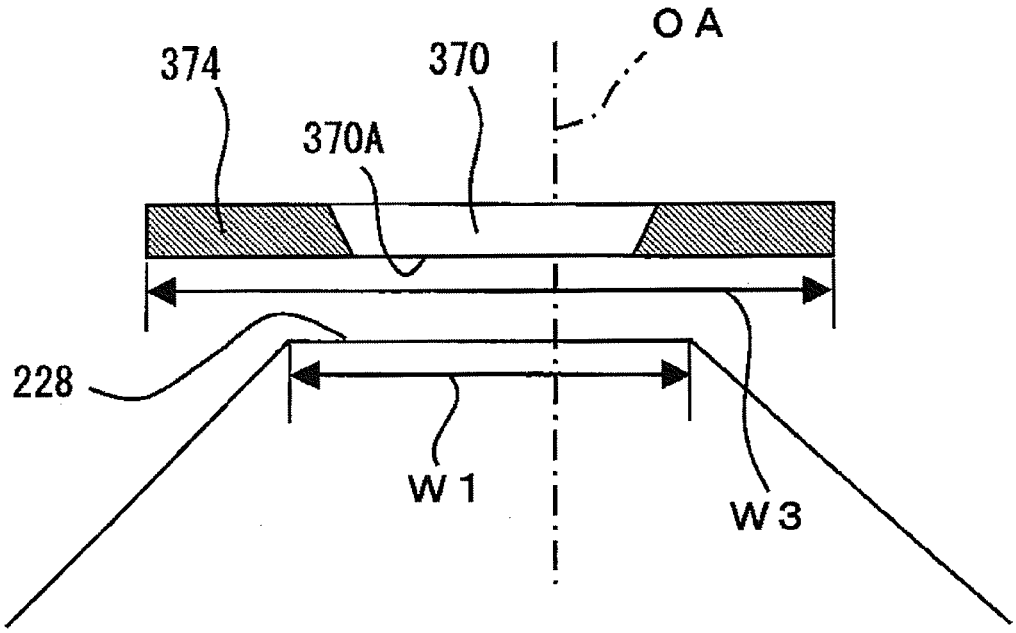
FIG. 12A is an exemplary diagram showing a fifth modification of the window glass and the positional relationship of the opposing surface according to the exemplary embodiment of the present invention.

In FIG. 12A, as the fifth modification, a detection surface 370A is formed by the window glass 370 and another member 374 provided continuously from the window glass 370. In this modification, a length W1 of the detection reference surface 228, which is the opposing surface, is shorter than a length W3 of the detection surface 370A. The other member 374 can be arbitrarily chosen from members such as sheet metal. Due to such a configuration, the length of the conveying path 60 (refer to FIG. 3) on which an upward force is exerted by the detection reference surface 228 is shorter than the length of the detection surface 370A. Accordingly, contact of the recording medium P with the detection surface 370A is reduced.

Figure 12B:
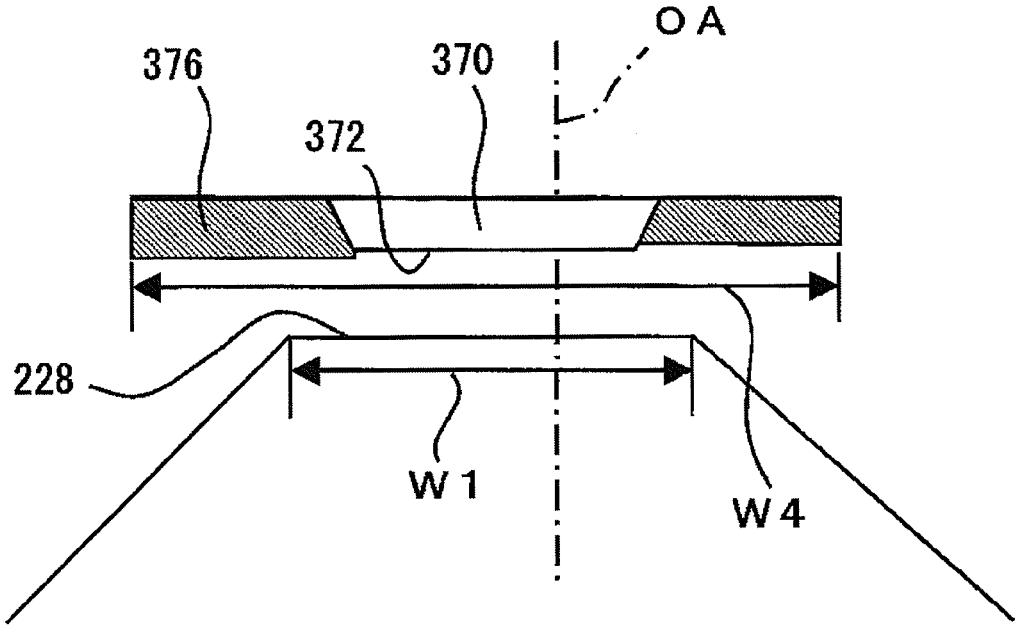
FIG. 12B is an exemplary diagram showing a sixth modification of the window glass and the positional relationship of the opposing surface according to the exemplary embodiment of the present invention.

FIG. 12B shows the sixth modification. The detection surface 370A of the fifth modification is further changed in the sixth modification and steps are formed in the arrangement of the window glass 370 and the other member 376. In this modification, the length W1 of the detection reference surface 228, which is the opposing surface, is shorter than the length W4 of the detection surface 372. Due to such a configuration, the length of the conveying path 60 (refer to FIG. 3) on which an upward force is exerted by the detection reference surface 228 is shorter than the length of the detection surface 372. Accordingly, contact of the recording medium P with the detection surface 372 is reduced. In addition, window glass having a trapezoidal shape in cross-section is used in FIGS. 12A and 12B, but the shape of the window glass is not limited thereto, and window glass with various cross-sectional shapes such as a rectangle or square may be used.

The present invention is not limited to the above-mentioned embodiments.

Image detection may be performed using a contact-type sensor substituted for the window glass 286, or contact-type sensors may be used for optical sensor parts including the CCD sensor 204 while the window glass 286 is maintained. Moreover, the convex parts 321 and 322 may be provided so as to exceed a reference line at either one or both of the upstream side and the downstream side of the detection surface 286A. Furthermore, one of the boundary parts 237 and 239 may be a curved shape. In addition, a fixed opposing member may be substituted for the rotatable reference roll 226. Although the light is provided from the front surface side of the recording medium P in the embodiments, the light may be provided from the back surface side of the recording medium P in a case in which the recording medium P that transmits light is used.

What is claimed is:

1. A detection apparatus comprising:

a transmission member that is provided facing a conveying path on which a medium is conveyed in a conveying direction, wherein the transmission member transmits light reflected from the medium being conveyed on the conveying path;

a detection section that detects an image on the medium according to the light which is transmitted by the transmission member and received by a light-receiving member of the detection section; and an opposing member provided on an opposite side of the conveying path from the transmission member and having an opposing surface that faces the transmission member, wherein a projecting section that projects further toward a side of the medium than the transmission member is provided at least one of an upstream side and a downstream side in the conveying direction of the medium with respect to the transmission member, wherein the opposing member has a plurality of planar surfaces including the opposing surface and an evacuation surface, wherein the opposing surface is directed to face the conveying path when the detection section is detecting the image on the medium, wherein the evacuation surface is directed to face the conveying path when the detection section is not detecting the image on the medium, wherein, when the opposing surface is directed to face the conveying path and when viewed from a direction horizontally intersecting the conveying direction of the medium, a tip of the projecting section projects toward a side of the opposing member and crosses an imaginary line extended from the opposing surface, and wherein, when the evacuation surface is directed to face the conveying path, the conveying path is formed at a larger distance from the transmission member than when the opposing surface is directed to face the conveying path, and the evacuation surface becomes closer to the transmission member as the evacuation surface extends toward the downstream side in the conveying direction of the medium.

2. The detection apparatus according to claim 1, wherein, when the opposing surface is directed to face the conveying path and when viewed from the direction horizontally intersecting the conveying direction of the medium, the projecting section projects toward a side of the opposing member and crosses an imaginary line that passes through a point on the opposing surface that is closest to the transmission member and perpendicularly intersects an optical axis of the light received by the light-receiving member.

3. The detection apparatus according to claim 1, wherein, when the opposing surface is directed to face the conveying path and when viewed from the direction horizontally intersecting the conveying direction of the medium, a point on the opposing surface that is closest to the transmission member is provided at an optical axis of the light received by the light-receiving member, and the projecting section projects towards a side of the opposing member and crosses an imaginary line that passes through the closest point to the transmission member on the opposing surface and intersects the optical axis perpendicularly.

4. The detection apparatus according to claim 1, wherein, when the opposing surface is directed to face the conveying path and when viewed from the direction horizontally intersecting the conveying direction of the medium, the opposing member has an upstream surface continuously provided at the upstream side in the conveying direction of the medium with respect to the opposing surface, and the upstream surface gradually approaches the transmission member as it extends toward the downstream side.

5. The detection apparatus according to claim 4, wherein a boundary between the opposing surface and the upstream surface is positioned at the upstream side in the conveying direction of the medium with respect to the optical axis of the light received by the light-receiving member.

6. The detection apparatus according to claim 4, wherein when viewed from a direction horizontally intersecting the conveying direction of the medium, an intersection point of an imaginary line extended from the upstream surface with the transmission member is positioned at the upstream side with respect to the optical axis.

7. The detection apparatus according to claim 4, wherein a portion between the opposing surface and the upstream surface is curved or chamfered.

8. The detection apparatus according to claim 1, wherein the opposing member has a downstream surface continuously provided at the downstream side in the conveying direction of the medium with respect to the opposing surface, and the downstream surface gradually diverges from the transmission member as it extends toward the downstream side.

9. The detection apparatus according to claim 8, wherein a portion between the opposing surface and the downstream surface is curved or chamfered.

10. The detection apparatus according to claim 1, wherein the detection section has a casing, and the projecting section is integrated with the casing.

11. The detection apparatus according to claim 1, wherein a guide member for guiding the medium toward the downstream side is provided at the downstream side in the conveying direction of the medium with respect to the transmission member, and an end portion of the guide member at the downstream side is curved in a direction which diverges from the conveying path.

12. The detection apparatus according to claim 1, wherein the opposing member is configured to rotate.

13. A detection apparatus comprising:

a transmission member that is provided facing a conveying path on which a medium is conveyed in a conveying direction, wherein the transmission member transmits light reflected from the medium being conveyed on the conveying path;

a detection section that detects an image on the medium according to the light which is transmitted by the transmission member and received by a light-receiving member of the detection section; and an opposing member provided on an opposite side of the conveying path from the transmission member and having an opposing surface that faces the transmission member, wherein the opposing member has an upstream surface located at an upstream side in the conveying direction of the medium with respect to the opposing surface, wherein a boundary between the opposing surface and the upstream surface is positioned at the upstream side in the conveying direction of the medium with respect to the optical axis of the light received by the light-receiving member, and wherein, in the conveying direction of the medium, a length of the opposing surface at the upstream side with respect to the optical axis is longer than a length of the opposing surface at the downstream side with respect to the optical axis.

14. The detection apparatus according to claim 13, wherein a projecting section that projects further toward a side of the medium than the transmission member is provided at least one of an upstream side and a downstream side in the conveying direction of the medium with respect to the transmission member, wherein the opposing member has a plurality of planar surfaces including the opposing surface and an evacuation surface, wherein the opposing surface is directed to face the conveying path when the detection section is detecting the image on the medium, wherein the evacuation surface is directed to face the conveying path when the detection section is not detecting the image on the medium, wherein, when the opposing surface is directed to face the conveying path and when viewed from a direction horizontally intersecting the conveying direction of the medium, a tip of the projecting section projects toward a side of the opposing member and crosses an imaginary line extended from the opposing surface, and wherein, when the evacuation surface is directed to face the conveying path, the conveying path is formed at a larger distance from the transmission member than when the opposing surface is directed to face the conveying path.

15. The detection apparatus according to claim 14, wherein, when the opposing surface is directed to face the conveying path and when viewed from the direction horizontally intersecting the conveying direction of the medium, the projecting section projects toward a side of the opposing member and crosses an imaginary line that passes through a point on the opposing surface that is closest to the transmission member and perpendicularly intersects an optical axis of the light received by the light-receiving member.

* * * * *